US010722781B1

(12) United States Patent
Braunschweig

(10) Patent No.: US 10,722,781 B1
(45) Date of Patent: Jul. 28, 2020

(54) SPORT SIMULATION BOARD GAME APPARATUS WITH PEGS AND METHOD

(71) Applicant: Jim Braunschweig, Dakota Dunes, SD (US)

(72) Inventor: Jim Braunschweig, Dakota Dunes, SD (US)

( * ) Notice: Subject to any disclaimer, the term of this patent is extended or adjusted under 35 U.S.C. 154(b) by 0 days.

(21) Appl. No.: 15/478,197

(22) Filed: Apr. 3, 2017

Related U.S. Application Data

(60) Provisional application No. 62/316,684, filed on Apr. 1, 2016.

(51) Int. Cl.
*A63F 7/06* (2006.01)
*A63F 3/00* (2006.01)
*A63F 7/07* (2006.01)

(52) U.S. Cl.
CPC ..... *A63F 7/06* (2013.01); *A63F 3/00041* (2013.01); *A63F 3/00047* (2013.01); *A63F 7/0612* (2013.01); *A63F 7/0616* (2013.01); *A63F 7/07* (2013.01)

(58) Field of Classification Search
CPC .... A63F 7/06; A63F 3/00041; A63F 3/00047; A63F 7/0612; A63F 7/0616; A63F 7/07
USPC ..... 273/108, 108.1, 108.5, 126 R, 398, 273/400–402, 317.1, 317.3
See application file for complete search history.

(56) References Cited

U.S. PATENT DOCUMENTS 160,234 A * 2/1875 Riedinger ..... A63F 9/16 273/108
406,342 A * 7/1889 Dumont ..... A63B 67/06 273/402
458,516 A * 8/1891 Bullen ..... A63F 7/0005 273/126 R
621,960 A * 3/1899 Coombs ..... A63F 7/0005 273/126 R
1,593,421 A * 7/1926 Blum ..... A63F 7/0017 273/108.5
1,819,932 A * 8/1931 Walden ..... A63F 7/0668 273/108.5
3,680,864 A * 8/1972 Peterson ..... A63F 9/16 273/108
3,722,888 A * 3/1973 Ducharme ..... A63F 7/3603 273/126 R (Continued)

OTHER PUBLICATIONS https://www.uncommongoods.com/product/penny-soccer-game.

*Primary Examiner* — Sebastiano Passaniti
(74) *Attorney, Agent, or Firm* — Mallory M. Henninger; Avent, LLP

(57) ABSTRACT

Aspects of the disclosure relate to a sport simulation board game apparatus configured to simulate the game play of a sport and method of sport simulation play. The sport simulation board game apparatus includes a game board and a game chip. The game chip is configured to move across the game board when a force is applied by a user's hand. The game board comprises one or more sets of pegs and one or more openings. The one or more sets of pegs are configured to present obstacles to prevent the game chip from directly entering the openings when propelled from the center of the game board. In implementations, the method of game play can be adjusted to accommodate users of a variety of ages and skill levels. In some embodiments, the game board can be customized to include images or text selected by the end user.

11 Claims, 25 Drawing Sheets

(56) References Cited

U.S. PATENT DOCUMENTS 3,734,504 A * 5/1973 Breslow ..... A63F 7/0017 273/126 R
3,827,691 A * 8/1974 Benander ..... A63F 7/0612 273/108.5
3,834,707 A * 9/1974 Birkett ..... A63F 7/0088 273/126 A
3,913,918 A * 10/1975 Trachtman ..... A63F 7/0668 273/126 R
4,032,150 A * 6/1977 Wilson ..... A63F 7/0017 273/126 R
4,060,245 A * 11/1977 Gamez Duch ..... A63F 7/0668 273/108.5
4,166,620 A * 9/1979 Sheppard ..... A63F 7/0017 273/108.5
4,261,568 A * 4/1981 Such ..... A63F 7/0668 273/108.5
4,274,635 A * 6/1981 Pakogian ..... A63F 7/0608 273/108.5
4,382,600 A * 5/1983 Vieira ..... A63F 7/0668 273/108.5
D277,014 S * 1/1985 Vieira ..... D21/339
4,560,163 A * 12/1985 Erickson ..... A63F 7/0668 273/108.1
D288,941 S * 3/1987 Germond ..... D21/365
4,765,622 A * 8/1988 Rienzo ..... A63F 7/0668 273/108.5
5,092,595 A * 3/1992 Daravina ..... A63F 7/0668 273/108.5
5,110,127 A * 5/1992 Potter ..... A63F 7/0668 273/108.5
5,242,164 A * 9/1993 Nicoll ..... A63F 7/0668 273/108.5
D351,867 S * 10/1994 Rafferty ..... D21/339
5,372,364 A * 12/1994 Arroyo ..... A63F 7/0668 273/108.5
5,431,397 A * 7/1995 Eckel ..... A63F 7/0668 273/108.1
D446,250 S * 8/2001 Quiroga ..... D21/318
6,345,820 B1 * 2/2002 Zucchi ..... A63F 7/3603 273/108.5
6,457,711 B1 * 10/2002 Baulesh ..... A63B 67/002 273/108.1
6,749,196 B2 * 6/2004 Serlachius ..... A63F 7/0684 273/108.51
7,204,487 B1 * 4/2007 Pohl ..... A63F 7/06 273/108.1
7,325,803 B1 * 2/2008 Miranda ..... A63F 7/0668 273/108.41
2014/0353910 A1 * 12/2014 Nwanna ..... A63F 7/06 273/108.1

* cited by examiner

SPORT SIMULATION BOARD GAME APPARATUS WITH PEGS AND METHOD

CROSS-REFERENCE TO RELATED APPLICATIONS

The present application claims the benefit under 35 U.S.C. § 119(e) of U.S. Provisional Application Ser. No. 62/316,684, filed Apr. 1, 2016, and titled "SPORT SIMULATION GAME BOARD APPARATUS WITH PEGS AND METHOD," which is herein incorporated by reference in its entirety.

BACKGROUND

A board game is a tabletop game that involves counters or pieces moved or placed on a pre-marked surface, or "board," according to a set of rules. Games can be based on pure strategy, chance (e.g., rolling dice), or a mixture of the two, and usually have a goal that a player aims to achieve. There are many varieties of board games with rules ranging from simple to complex.

SUMMARY

This Summary is provided to introduce a selection of concepts in a simplified form that are further described below in the Detailed Description. This Summary is not intended to identify key and/or essential features of the claimed subject matter. Also, this Summary is not intended to limit the scope of the claimed subject matter in any manner.

Aspects of the disclosure relate to a sport simulation board apparatus configured to simulate the game play of a sport and method of sport simulation play. The sport simulation board game apparatus includes a game board and a game chip. The game chip is configured to move across the game board when a force is applied by a user's hand. The game board comprises one or more sets of pegs and one or more openings. The one or more sets of pegs are configured to present obstacles to prevent the game chip from directly entering the openings when propelled from the center of the game board. In implementations, the method of game play can be adjusted to accommodate users of a variety of ages and skill levels. In some embodiments, the game board can be customized to include images or text selected by the end user.

DRAWINGS

The Detailed Description is described with reference to the accompanying figures. The use of the same reference numbers in different instances in the description and the figures may indicate similar or identical items.

DETAILED DESCRIPTION

Figure 1:
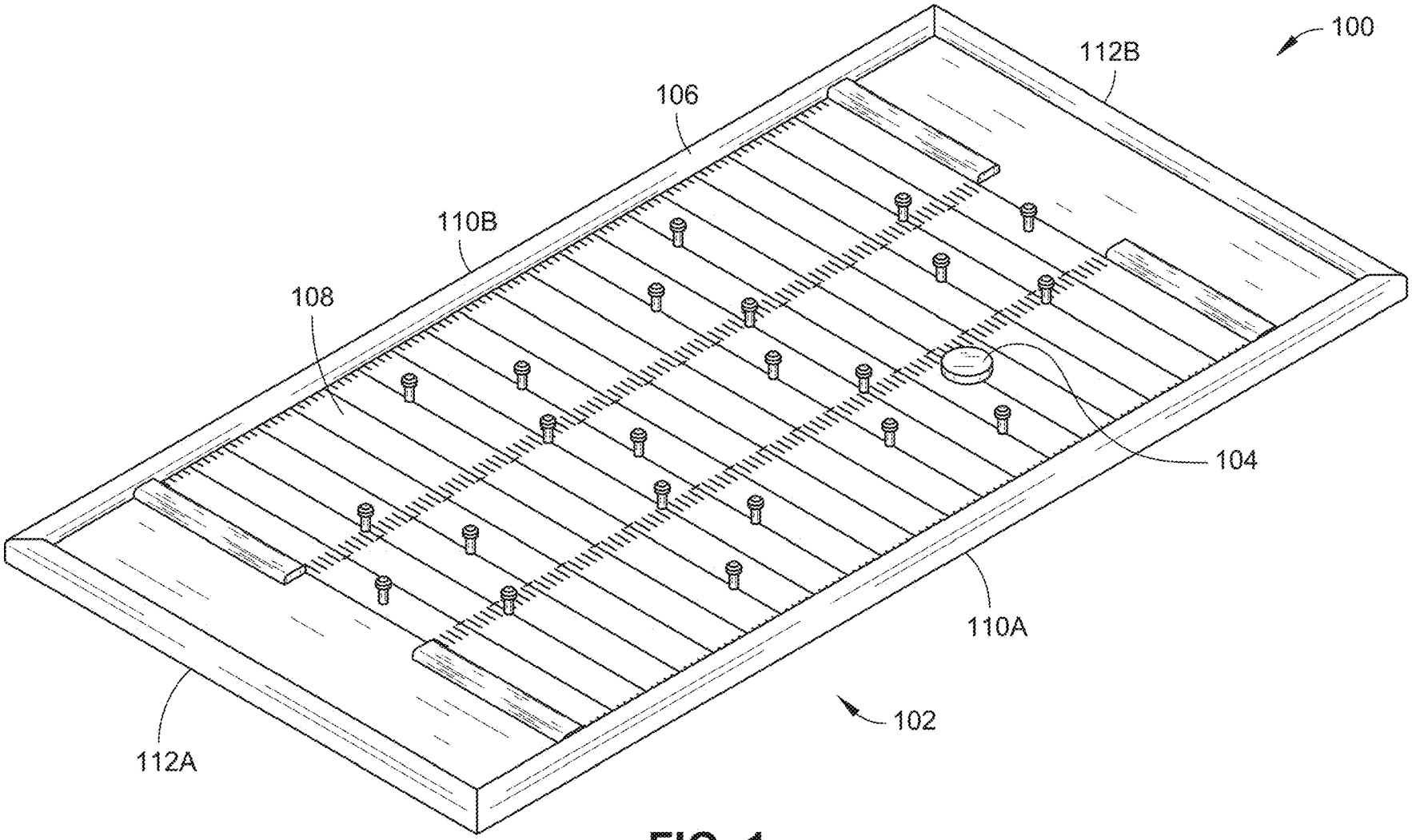
FIG. 1 is a perspective view illustrating a sport simulation board game apparatus in accordance with example embodiments of the present disclosure.

Aspects of the disclosure are described more fully hereinafter with reference to the accompanying drawings, which form a part hereof, and which show, by way of illustration, example features. The features can, however, be embodied in many different forms and should not be construed as limited to the combinations set forth herein; rather, these combinations are provided so that this disclosure will be thorough and complete, and will fully convey the scope. The following detailed description is, therefore, not to be taken in a limiting sense.

Overview

Board games have been extremely popular for many years with all ages of participants. While certain board games have waned in popularity, other well known games have retained wide notoriety and acceptance.

Unfortunately, many players of conventional board games begin to tire from engaging in identical game play over a plurality of playing times. The resulting boredom may stifle interest in the particular board game. It can also be difficult to develop a game that is simple enough for young or novice players, while still posing a challenge to older and/or more experienced players. Many board games have complex, fixed rules that can be difficult for young and/or inexperienced players to grasp. For this reason, board games are often tailored to specific age ranges and/or skill levels. Thus, there is a lack of board games that can be enjoyable for a group (e.g., a family) that includes players of varying ages and skill levels.

Additionally, there are limited board games featuring realistic simulation sports play (e.g., soccer, football, etc.). The sport simulation board games currently marketed often have intricate rules and tend to be geared towards older players.

Another drawback to existing board games is that they have limited use other than as a game. For example, when the game is not being played, it is typically boxed and stored.

Aspects of the disclosure relate to a sport simulation board game apparatus configured to simulate the game play of a sport and method of sport simulation play. The sport simulation board game apparatus includes a game board and a game chip. The game chip is configured to move across the game board when a force is applied by a user's hand. The game board comprises one or more sets of pegs and one or more openings. The one or more sets of pegs are configured to present obstacles to prevent the game chip from directly entering the openings when propelled from the center of the game board. In implementations, the method of game play can be adjusted to accommodate users of a variety of ages and skill levels. In some embodiments, the game board can be customized to include images or text selected by the end user.

Example Embodiments

Referring generally to FIGS. 1 through 8, a sport simulation board game apparatus 100 is described in accordance with example embodiments of the present disclosure. The sport simulation board game apparatus includes a game board 102 and one or more game chips 104.

In embodiments, the game board 102 can be rigid and elongated, as illustrated in FIG. 1. The dimensions of the game board 102 can be selected so as to both simulate a scaled athletic field and to maintain adequate surface area for game play. In an example embodiment, the dimensions of the game board 102 can be approximately 16.5 inches wide and approximately 32.5 inches long. In another example embodiment, the dimensions of the game board 102 can be approximately 18.5 inches wide and approximately 25.5 inches long. In another example embodiment, the dimensions of the game board can be approximately 16.25 inches wide and approximately 32 inches long. However, these dimensions are offered by way of example only and are not meant to be restrictive of the present disclosure. In other embodiments, different dimensions can be utilized, and the dimensions can be tailored to different sports (e.g., basketball, hockey, baseball, etc.). In embodiments, the game board 102 can be constructed from one or more different materials including, but not necessarily limited to: wood, metal, plastic, and so forth.

Figure 2:
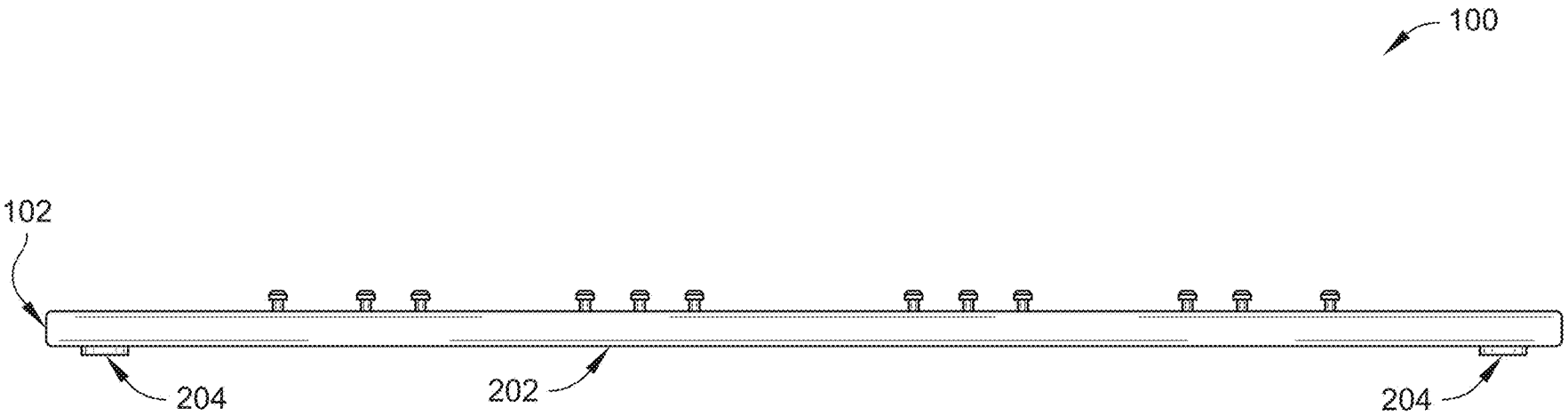
FIG. 2 is a front view of the sport simulation board game apparatus illustrated in FIG. 1.
Figure 3:
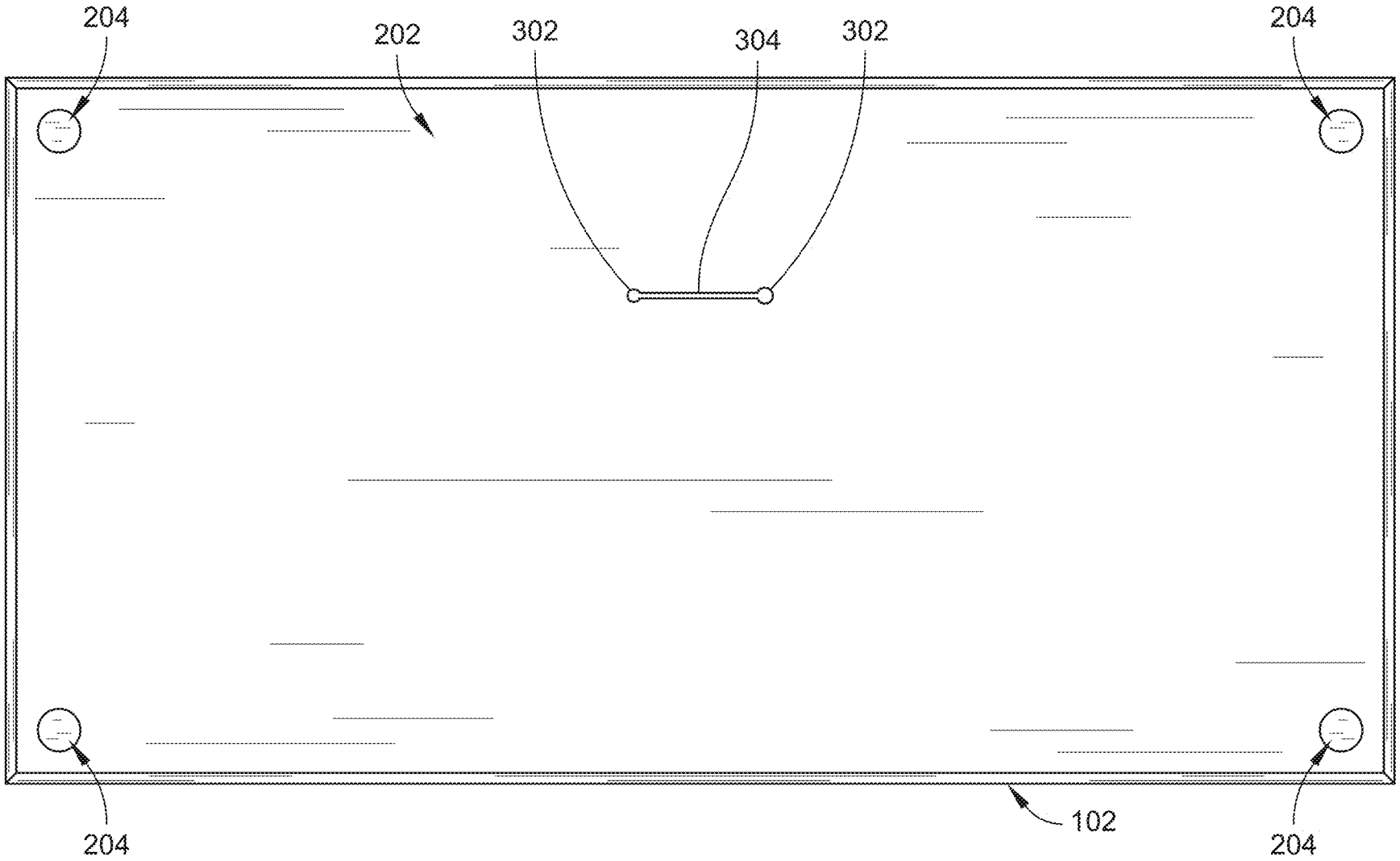
FIG. 3 is a bottom view of the sport simulation board game apparatus illustrated in FIG. 1, including mounting holes and a mounting slot in accordance with example embodiments of the present disclosure.

Referring now to FIGS. 2 and 3, the game board 102 includes a bottom surface 202 that is configured to allow the game board to rest on a support surface (e.g., table top, floor, ground, etc.). The bottom surface 202 can be flat to allow the game board to rest securely on the support surface. In some embodiments, one or more feet (e.g., pads 204) can be disposed on the bottom surface, as illustrated in FIGS. 2 and 3. While four pads 204 are shown disposed near the corners of the bottom surface in FIGS. 2 and 3, it is to be understood that this number and configuration of pads 204 is offered by way of example only and is not meant to be restrictive of the present disclosure. Other numbers of feet and/or pads can be utilized to provide stable support for the game board. The pads 204 can also be disposed in other configurations on the bottom surface 202. For example, the pads 204 can be spaced around the periphery of the game board 102 to provide added stability and support.

In embodiments, the bottom surface 202 can include one or more mounting holes 302 and/or mounting slots 304, as illustrated in FIG. 3. The mounting holes 302 and/or mounting slots 304 can be configured for removably mounting (i.e., hanging) the game board 102 on a flat surface (e.g., wall, door, etc.). In some example embodiments, the bottom surface can include at least two mounting holes connected by a mounting slot. The mounting holes 302 and/or mounting slots 304 can be configured for engaging and retaining one or more fasteners (e.g., nails, screws, etc.). For example, a diameter of the mounting holes 302 can be selected that is greater than the diameter of the head of the fastener, permitting the mounting hole 302 to engage the head of the fastener. A width of the mounting slot 304 can be selected that is narrower than the head of the fastener and/or narrower than the mounting hole 302. Thus, the head of the fastener can enter the mounting hole 302 and the fastener can be slid into the mounting slot 304. The narrower mounting slot 304 can then retain the head of the fastener, removably securing the game board to a surface. However, this combination of mounting holes, mounting slots, and fasteners is offered by way of example only, and is not meant to be restrictive of the present disclosure. In other embodiments, various configurations and combinations of mounting holes, mounting slots, and/or fasteners can be used. Other types of fasteners can be utilized including, but not necessarily limited to: wire, string, d-rings, bolts, and so forth, or any combination thereof. The mounting holes 302 and/or mounting slots 304 can be formed by conventional means, such as punching or drilling. The mounting holes 302 and/or mounting slots 304 enable the game board to be displayed when not being used for play.

The game board 102 can also include a raised perimeter consisting of four edge portions which forms a shoulder 106 around a recessed interior surface 108 that is bound by sides 110A, 110B and ends 112A, 112B (e.g., as described with reference to FIG. 1). The shoulder 106 thus forms a retaining rim around the recessed interior surface 108.

Figure 4:
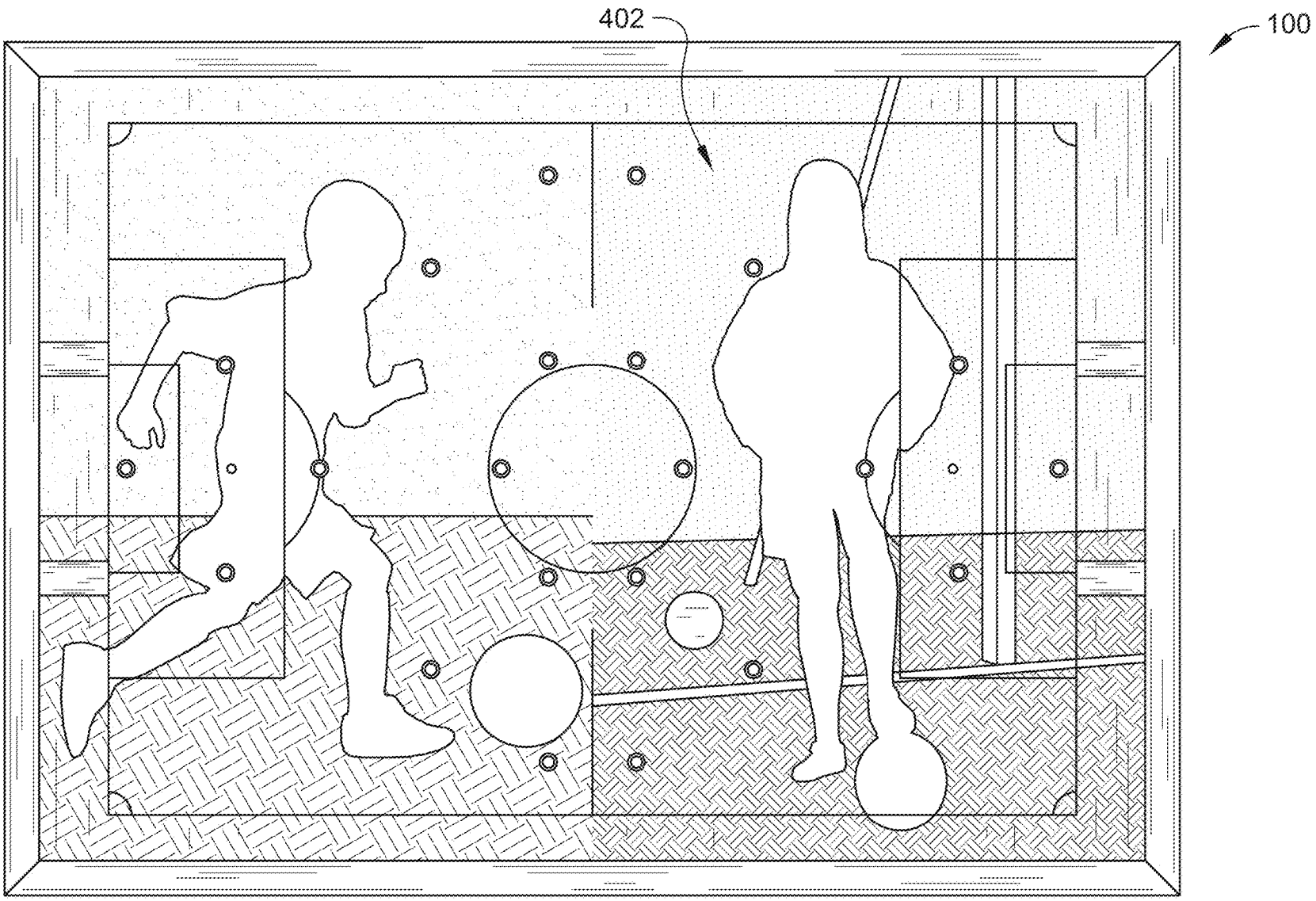
FIG. 4 is a top view illustrating a sport simulation board game apparatus, such as the sport simulation board game apparatus of FIG. 1, including a customizable interior surface in accordance with example embodiments of the present disclosure.

In embodiments, the recessed interior surface 108 can comprise a customizable surface 402 that can include one or more images, text, or a combination thereof, selected by an end user, as illustrated in FIG. 4. In some embodiments, the customizable surface 402 can include images and/or text comprising a sports team logo. In other embodiments, the customizable surface 402 can include photographs or text (e.g., a name, phrase, slogan, etc.) selected by the end user. In some embodiments, the recessed interior surface 108 and/or customizable surface 402 can be configured to resemble an athletic field (e.g., football field, soccer field, basketball court, hockey arena, baseball field, etc.). The images and/or text can be applied to the recessed interior surface 108 and/or customizable surface 402 using any suitable technique including, but not necessarily limited to: screen printing, digital printing, hand painting, and so forth. The combination of the customizability of the recessed interior surface 108 and the mounting holes/mounting slots enables the end user to create a keepsake item and/or piece of memorabilia that can be displayed when the game board is not being utilized for play.

Example Football Game Board Embodiment

Referring now to FIGS. 5A through 5G, the recessed interior surface 108 can be configured as a football field. The interior surface can include goals 502A, 502B located near each end 112A, 112B of the game board 102, respectively. In some embodiments, each goal 502A, 502B can comprise one or more centrally located opening defined by one or more goal members. The openings face each other as on a traditional football field. For example, the recessed interior surface 108 can include a first opening 504A and a second opening 504B located on opposing ends 112A, 112B of the elongated game board 102. In some embodiments, the first and second openings 504A, 504B are bound by respective goal lines 506A, 506B. In embodiments, each of the openings 504A, 504B can be defined by two goal members 508A, 508B fixed to the opposing sides 110A, 110B of the recessed interior surface 108 and extending laterally across the width of the recessed interior surface 108, forming end zones 510A, 510B. The width of the openings 504A, 504B is significant in terms of the relationship to the chip 104 diameter. For example, an opening width can be selected that is wide enough for the chip 104 to pass through, but narrow enough to create a challenge for players. In example embodiments, the ratio between the width of the opening 504A, 504B and each goal member 508A, 508B is approximately 1:1, and the ratio between the width the opening 504A, 504B and the side-to-side width of the recessed interior surface 108 is approximately 1:3. The width of the openings 504A, 504B is also significant in relation to the positioning of the pegs, as discussed below. For example, an opening width can be selected that permits the game chip 104 to pass through on either side of a peg positioned in front of the opening 504A, 504B. In some example embodiments, the opening width can be between about 3.5 inches and about 5.5 inches. In some embodiments, the goals 502A, 502B can be covered by mesh, netting, or a similar material.

In embodiments, the recessed interior surface 108 can include a plurality of transversely extending lines which run parallel to the goals 502A, 502B. For example, the interior surface 108 can be marked with a 50 yard line 512 near the center and decreasing yard lines 522 to each of the goals 502A, 502B. The interior surface 108 can also include single yard lines (e.g., hash marks). The lines can be applied to the recessed interior surface 108 using any suitable technique including, but not necessarily limited to: screen printing, digital printing, hand painting, and so forth.

Still referring to FIGS. 5A through 5H, the game board 102 further comprises a plurality of pegs securely (e.g., immovably, permanently, etc.) attached to the recessed interior surface. In embodiments, pegs can be formed from wood, plastic, metal, or the like. The pegs can be positioned so as to simulate a football game and/or provide an obstacle for the chip. For example, there can be approximately 11 pegs disposed on each side of the 50 yard line 512. The pegs can also be positioned in such a way as to approximate the locations of players on a football field. In some embodiments, the pegs can be positioned in a linear arrangement to both approximate the positions of football players, and permit the chip 104 to pass between the pegs, as illustrated in FIG. A.

Figure 5A:
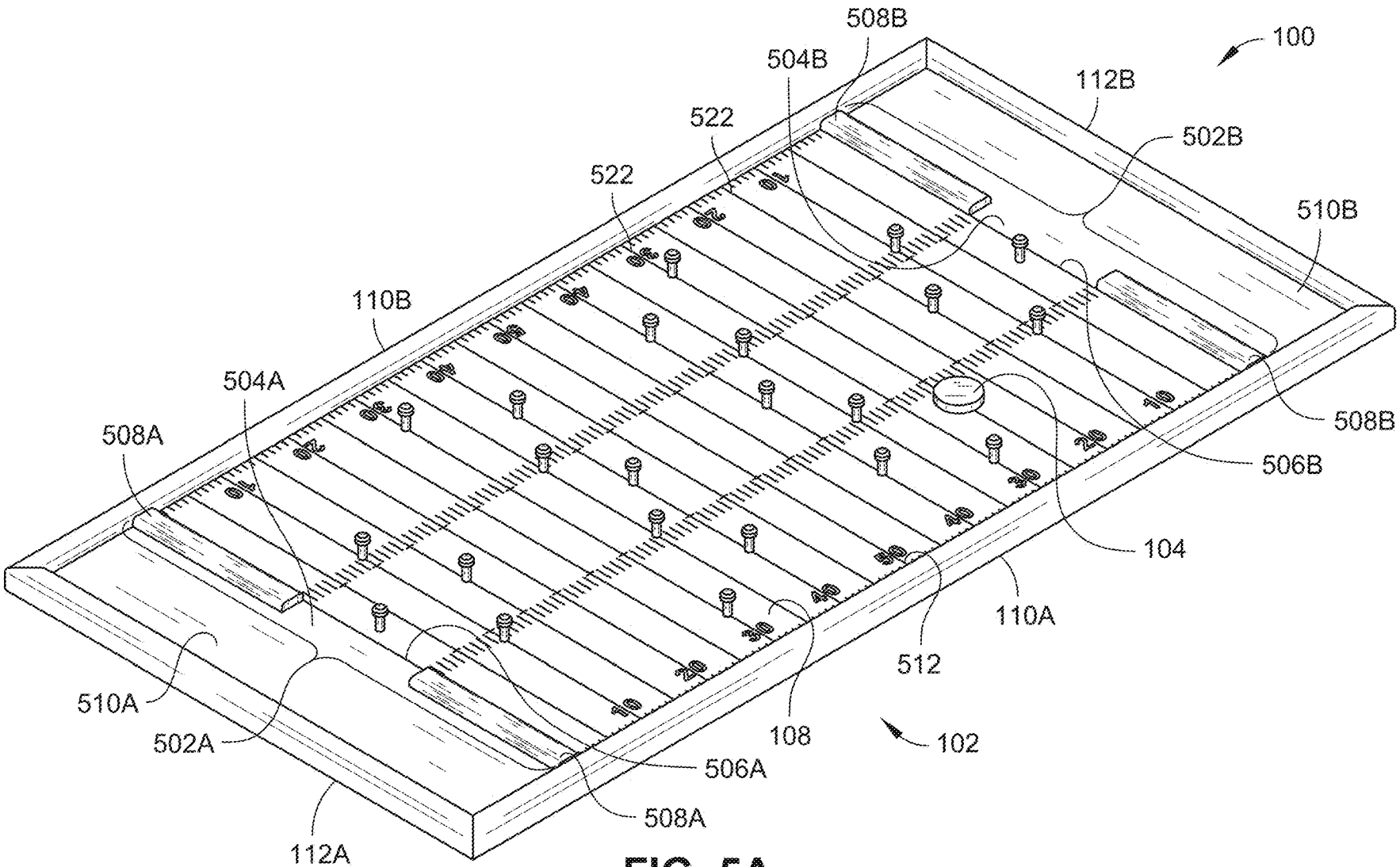
FIG. 5A is a perspective view illustrating a sport simulation board game apparatus configured as a football field in accordance with example embodiments of the present disclosure.
Figure 5B:
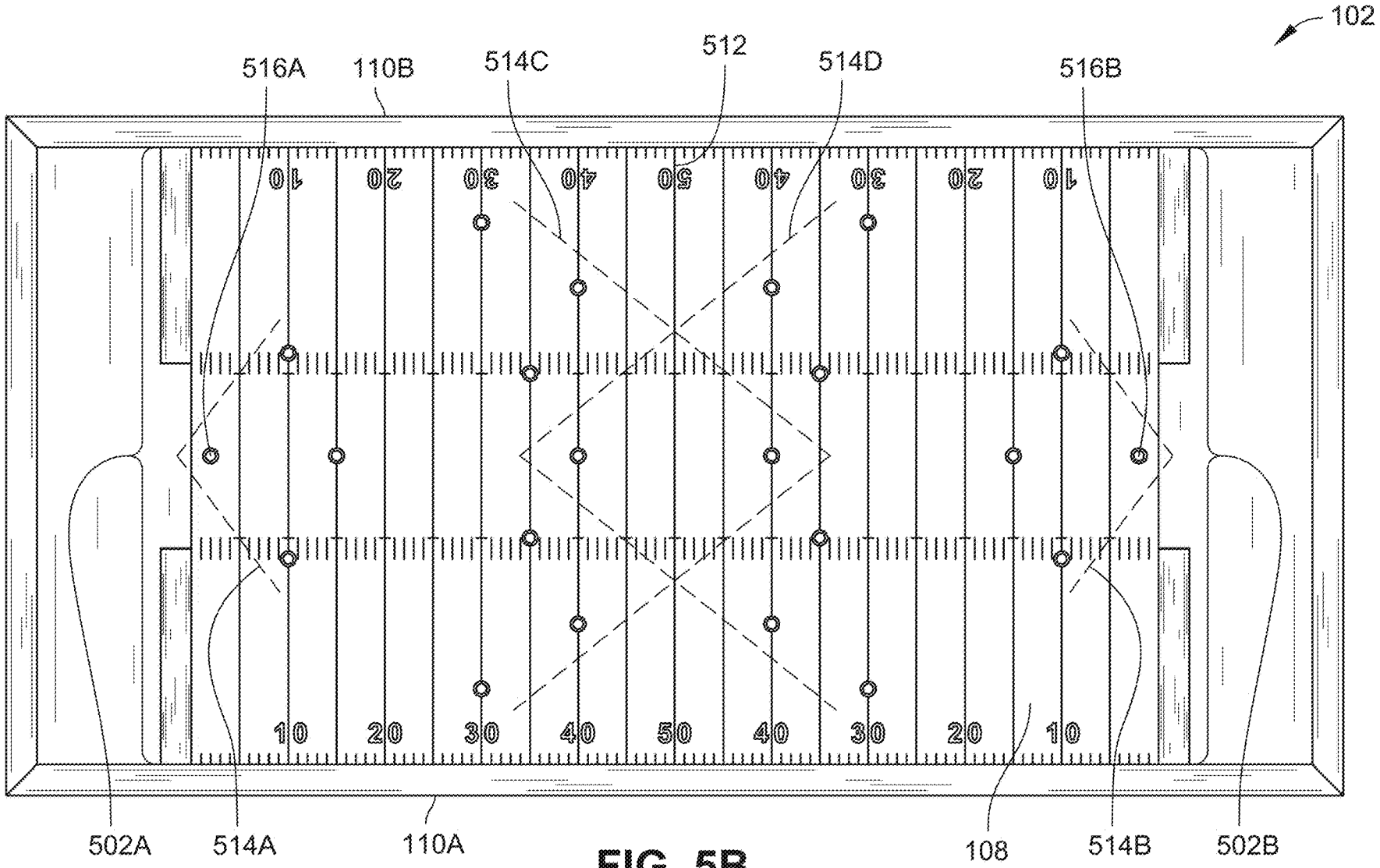
FIG. 5B is a top view of the sport simulation board game apparatus illustrated in FIG. 5A.
Figure 5C:
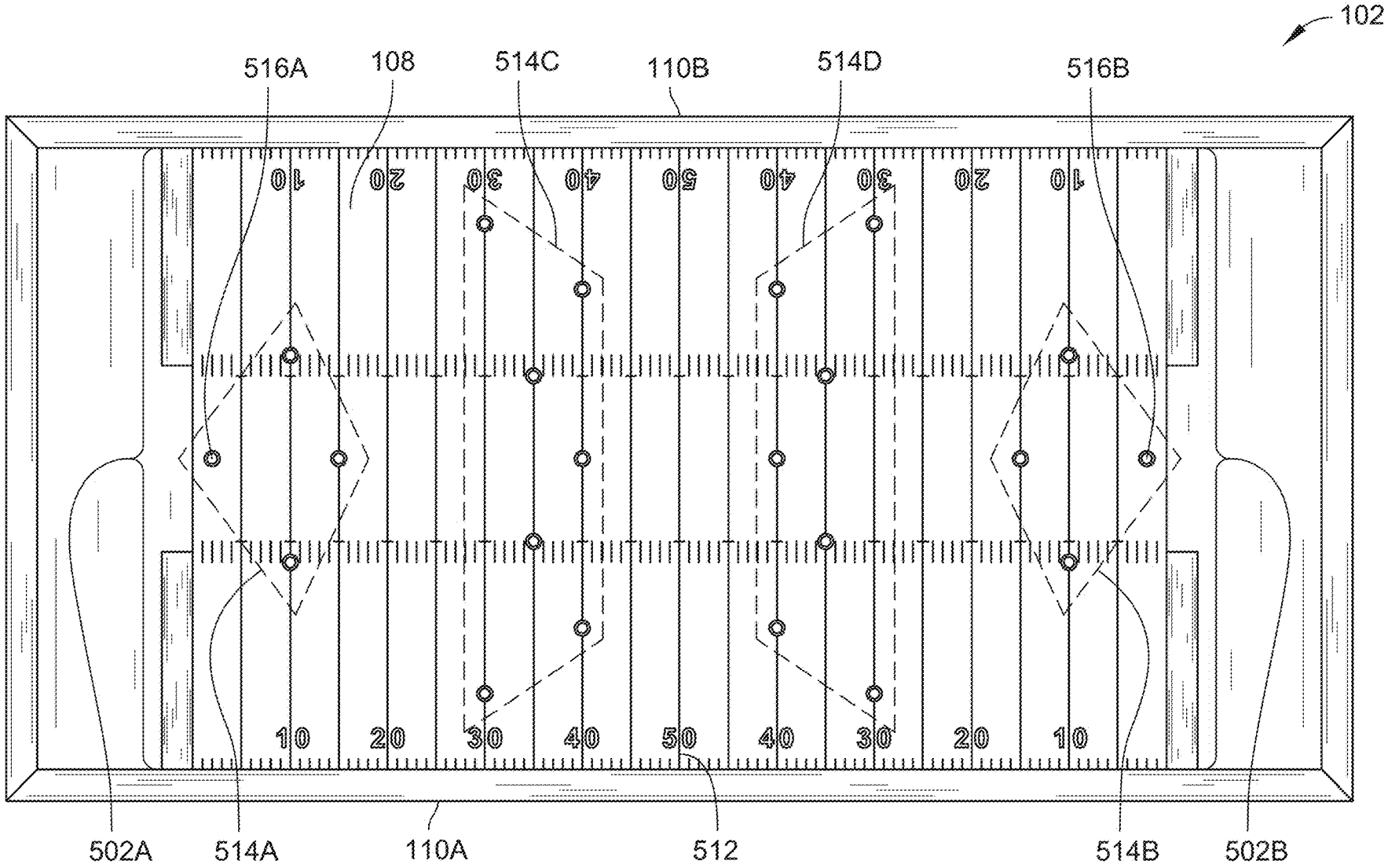
FIG. 5C is another top view of the sport simulation board game apparatus illustrated in FIG. 5A.

Referring now to FIGS. 5B and 5C, the game board 102 can include first and second sets of pegs 514A, 514B disposed proximate to the goals 502A and 502B, respectively. These sets of pegs 514A, 514B can be disposed in a chevron arrangement (e.g., as described with reference to FIG. 5B) or a quadrilateral (e.g., diamond, rhombus, etc.; as described with reference to FIG. 5C) arrangement, with at least one peg 516A, 516B centrally positioned in front of each goal 502A, 502B. These centrally positioned pegs 516A, 516B are disposed equidistant from the sides 110A, 110B of the game board 102, and are configured to deflect direct shots of the chip taken from the center of the game board and prevent direct shots on goal. In embodiments, the first and second sets of pegs 514A, 514B are disposed on or between the goal 502A, 502B and the 20 yard line on opposing sides of the recessed interior surface 108. In specific embodiments, first and second sets of pegs 514A, 514B are disposed on or between the goal and the 15 yard line on opposing sides of the recessed interior surface 108 (e.g., on opposing sides of the 50 yard line; as described with reference to FIG. 5B).

In some embodiments, the game board 102 can also include one or more additional sets of pegs. For example, the game board 102 can include third and fourth sets of pegs 514C and 514D, respectively, disposed in a chevron configuration (e.g., as described with reference to FIG. 5B). For example, the recessed interior surface can include a third set of pegs 514C arranged in a third chevron disposed on or between the 20 yard lines, and a fourth set of pegs 514D arranged in a fourth chevron disposed on or between the 20 yard lines. In a specific embodiment, the recessed interior surface includes a third set of pegs 514C arranged in a third chevron disposed on or between the 30 yard line and the opposing 40 yard line, and a second set of pegs 514D arranged in a fourth chevron opposite the third chevron (e.g., on opposing sides of the 50 yard line 512) disposed on or between the 30 yard line and the opposing 40 yard line (e.g., as described with reference to FIG. 5B).

As shown in FIGS. 5B and 5C, the plurality of pegs (e.g., sets of pegs 514A, 514B, 514C, 514D) can define one or more gaps of space dividing the plurality of pegs into discrete groups. The gap of space provides at least one unobstructed portion of the recessed interior surface 108 having no pegs and spanning the width of the game board (e.g., between sides 110A and 110B).

Referring now to FIG. 5C, one or more of the pegs can be arranged in a trapezoidal configuration. For example, the pegs can be arranged in sets to form one or more trapezoids. In an embodiment, the third sets of pegs 514C can define a first trapezoid and the fourth set of pegs 514D can define a second trapezoid. In a specific embodiment, the third set of pegs 514C and the fourth set of pegs 514D can define first and second trapezoids, respectively, disposed on or between the 30 yard line and the 40 on opposing sides of the interior surface (e.g., on opposing sides of the 50 yard line).

Figure 5D:
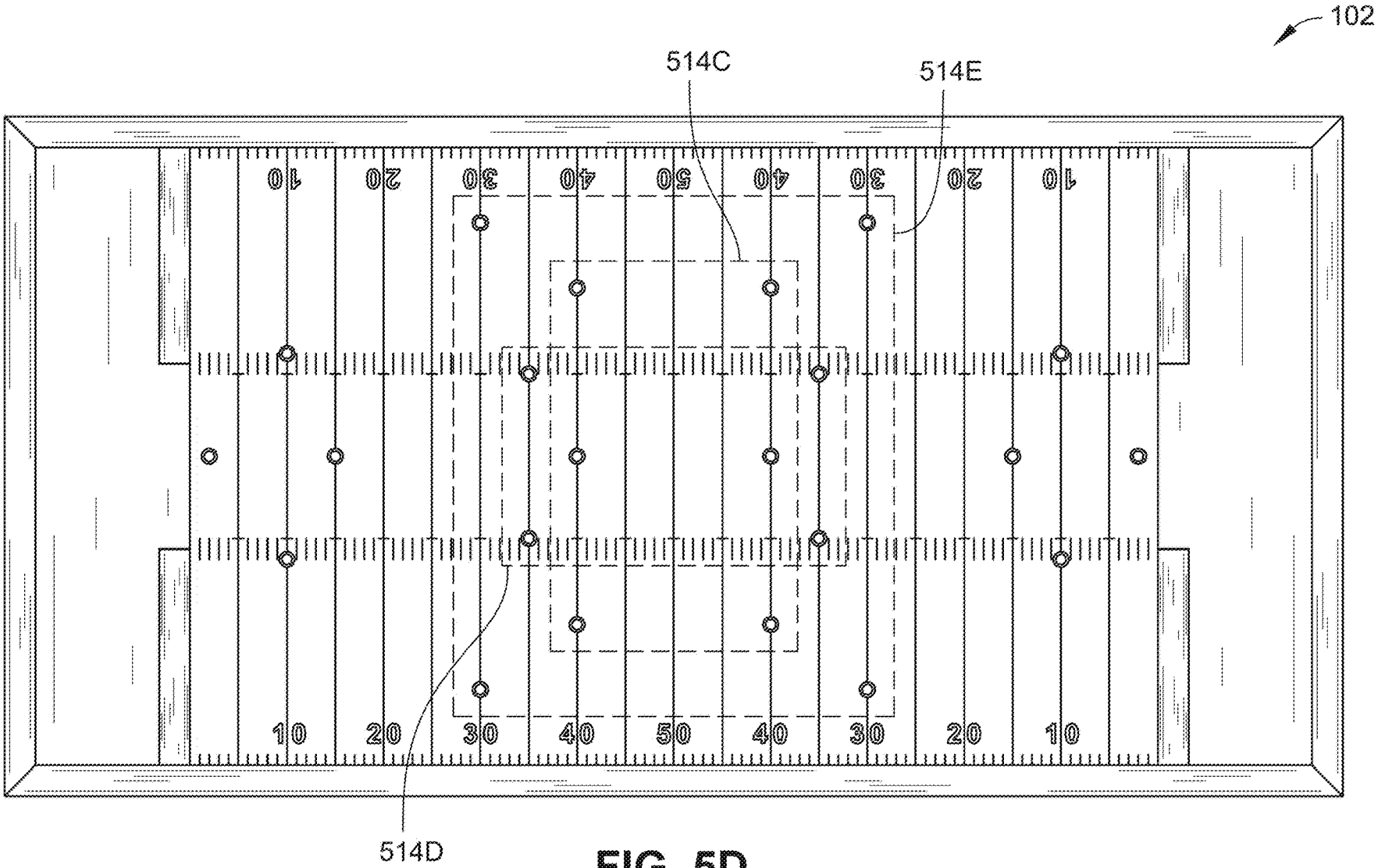
FIG. 5D is another top view of the sport simulation board game apparatus illustrated in FIG. 5A.

Referring now to FIG. 5D, one or more of the pegs can be arranged in a rectangular configuration. For example, the pegs can be arranged in sets to form one or more rectangles. In an embodiment, the third set of pegs 514C and the fourth set of pegs 514D can define intersecting first and second rectangles. The third and fourth sets of pegs 514C, 514D can be bound by an additional set of pegs 514E arranged in a third rectangle.

Figure 5E:
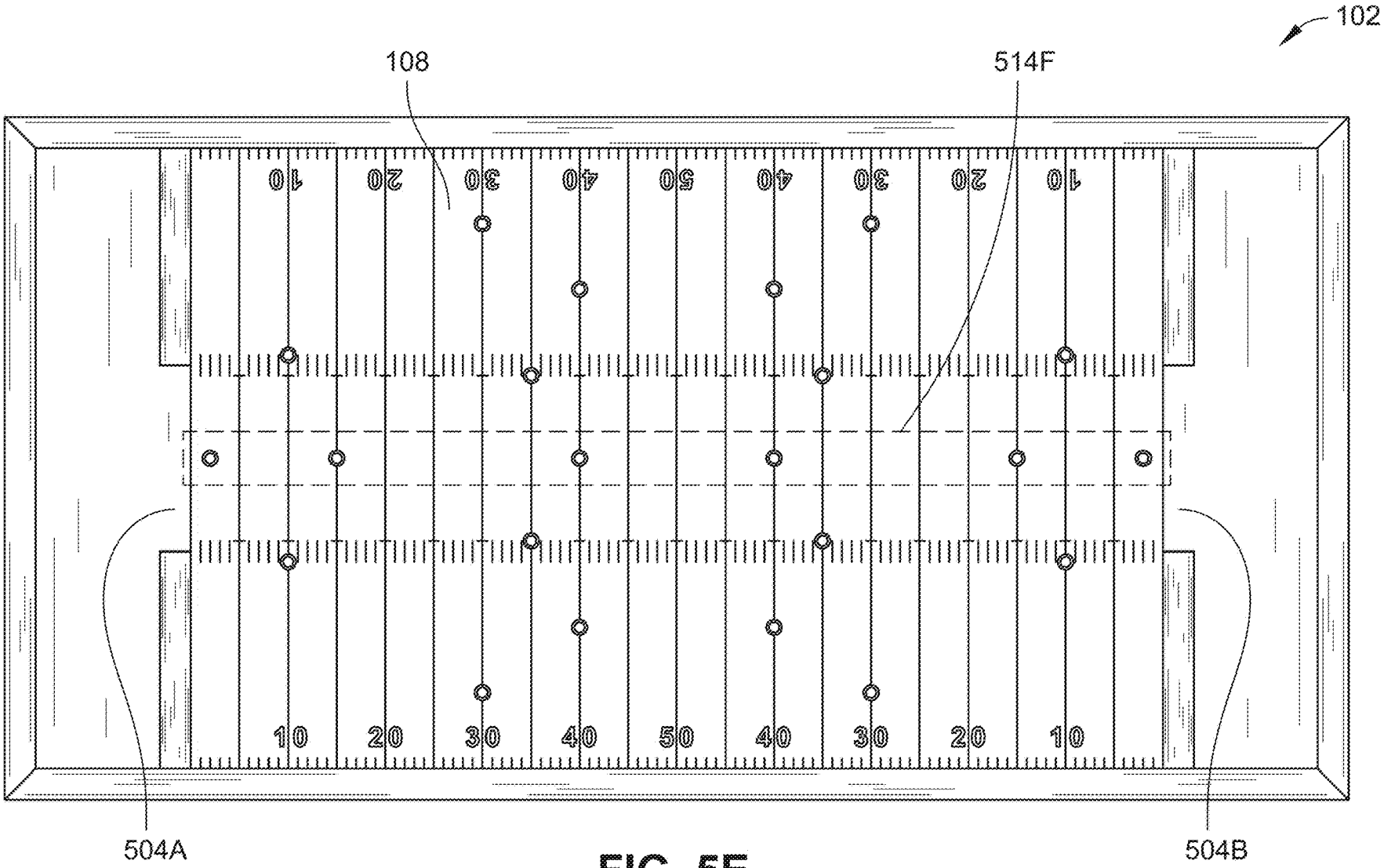
FIG. 5E is another top view of the sport simulation board game apparatus illustrated in FIG. 5A.

Referring now to FIG. 5E, a plurality of pegs may be arranged in a transverse line extending lengthwise across the recessed surface 108. For example, the game board 102 can include a set of pegs 514F extending transversely and lengthwise across the center of the recessed surface 108 from opening 504A to opening 504B. This set of centrally positioned pegs 514F is configured to deflect direct shots of the chip 104 taken from the center of the game board 102.

Figure 5F:
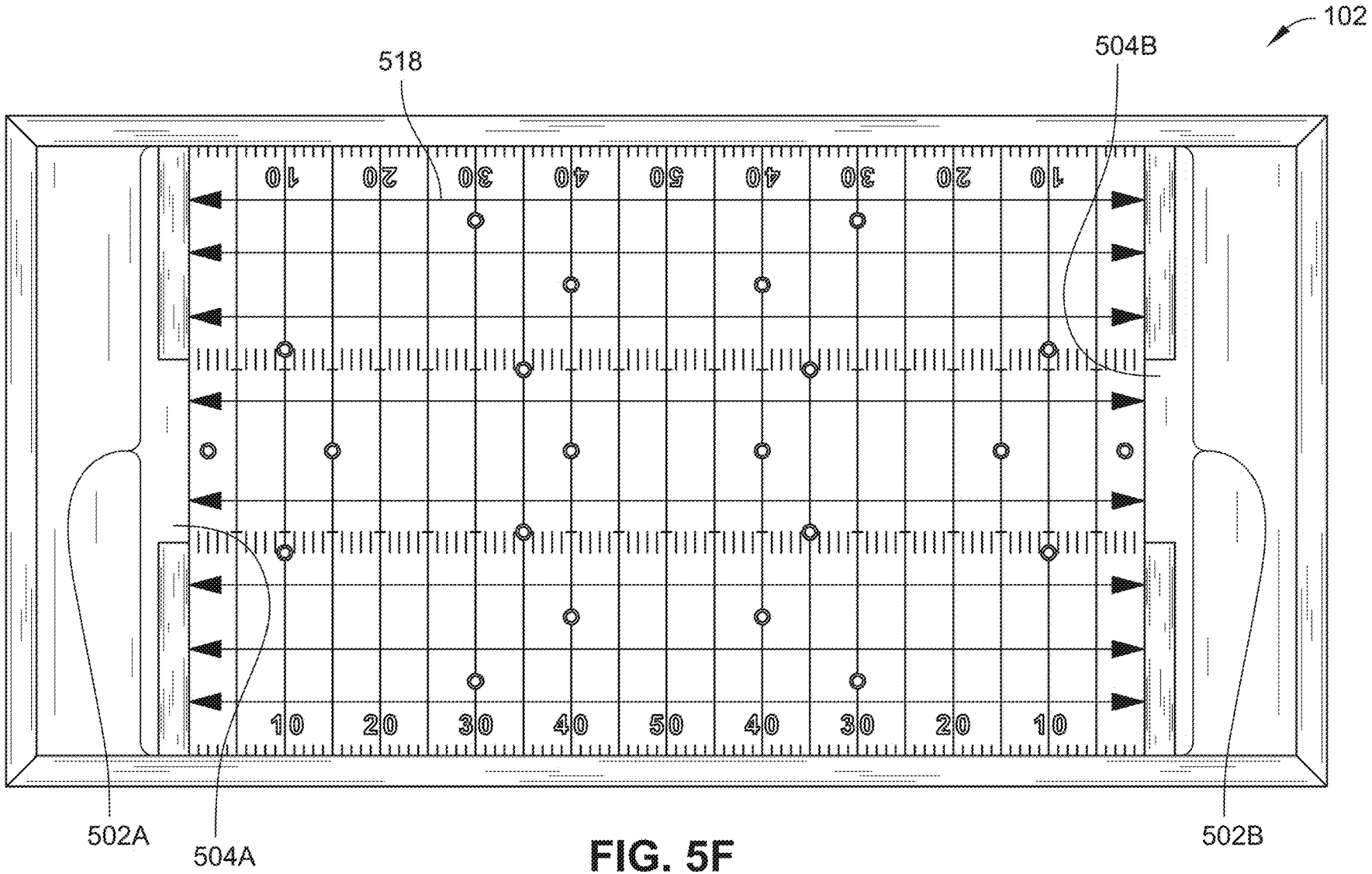
FIG. 5F is another top view of the sport simulation board game apparatus illustrated in FIG. 5A.
Figure 5G:
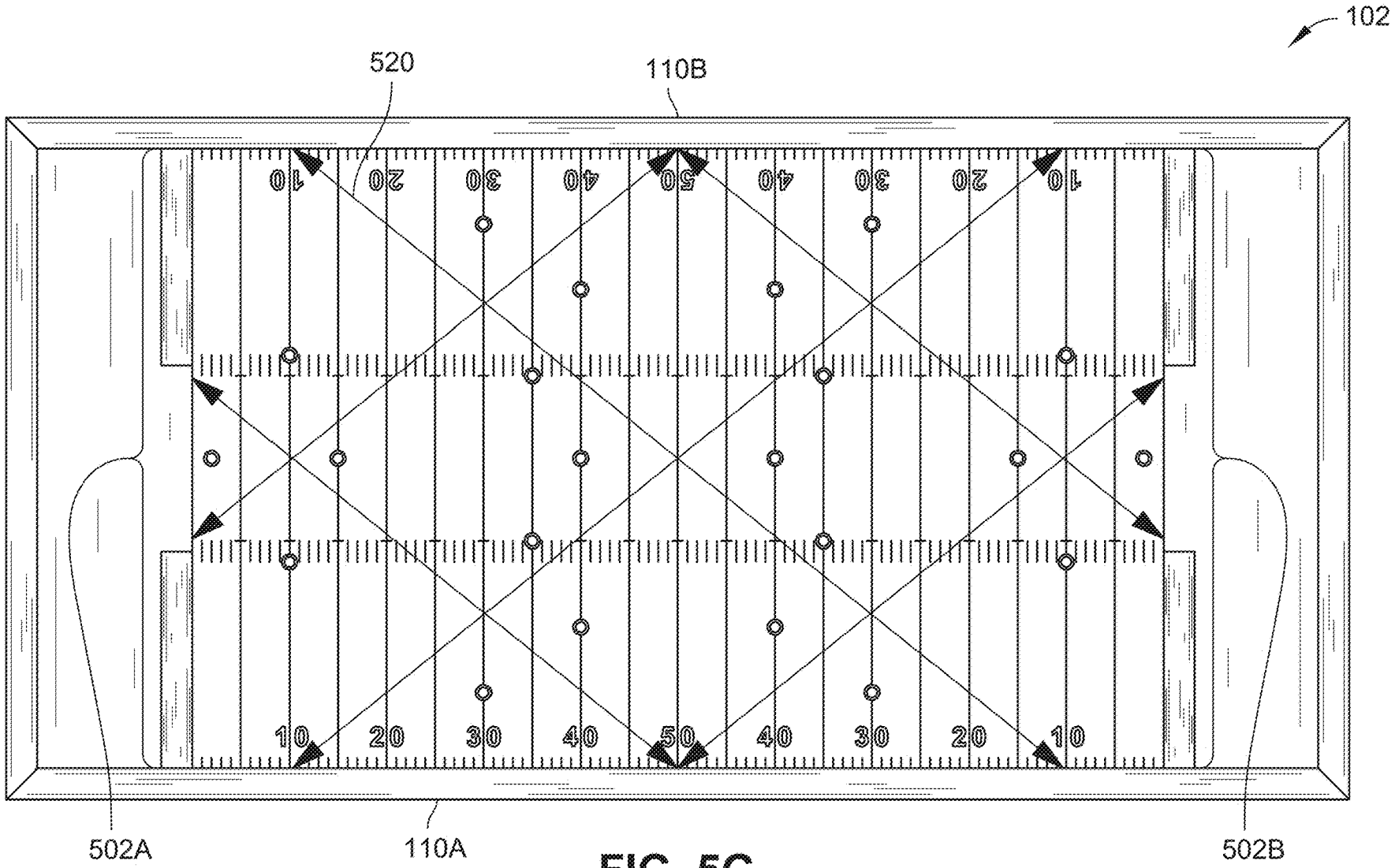
FIG. 5G is another top view of the sport simulation board game apparatus illustrated in FIG. 5A.

Referring now to FIGS. 5F and 5G, the pegs may define one or more channels for allowing the chip to pass. For example, the pegs can define one or more channels 518 extending transversely and lengthwise across the recessed interior surface 108 from goal 502A to goal 502B (e.g., as described with reference to FIG. 5F). The pegs in combination with the perimeter of the game board 102 may also define transversely and lengthwise extending channels 518. The channels 518 can allow the chip (not shown) to pass transversely across the length of the game board 102 without obstruction. For example, the chip can pass from opening 504A to opposing opening 504B without obstruction. The pegs may also define one or more diagonally extending channels 520 (e.g., as described with reference to FIG. 5G). The channels 520 allow the chip to pass diagonally across the interior surface 108 without obstruction. The width of the channels 518, 520 is significant in terms of relationship to chip size. For example, the width of the channels 518, 520 can be selected so as to be larger than the diameter of the chip, but narrow enough to provide a challenging obstacle. In some example embodiments, the channels pegs can be at least about 1.25 inches to about 2.5 inches wide. The spacing of the pegs is also significant in terms of the relationship to the chip. The spacing is selected so as to be larger than the diameter of the chip and allow the chip to pass between the pegs, but small enough to provide a challenging obstacle. In some example embodiments, the pegs can be spaced at least about 1.25 inches to about 2.5 inches apart. Additionally, the spacing between the outermost pegs and the sides of the game board can be at least about 1.25 inches to about 2.5 inches. In embodiments, the spacing between pegs can be increased or decreased to adjust the difficulty of game play. For example, a game board designed for younger players may have wider spacing between pegs. The transversely extending channels 518 and the diagonally extending channels 518 can increase the amount of skill and challenge required for game play. For example, players can use channels 518, 520 and strategic bank shots to score more efficiently.

Figure 5H:
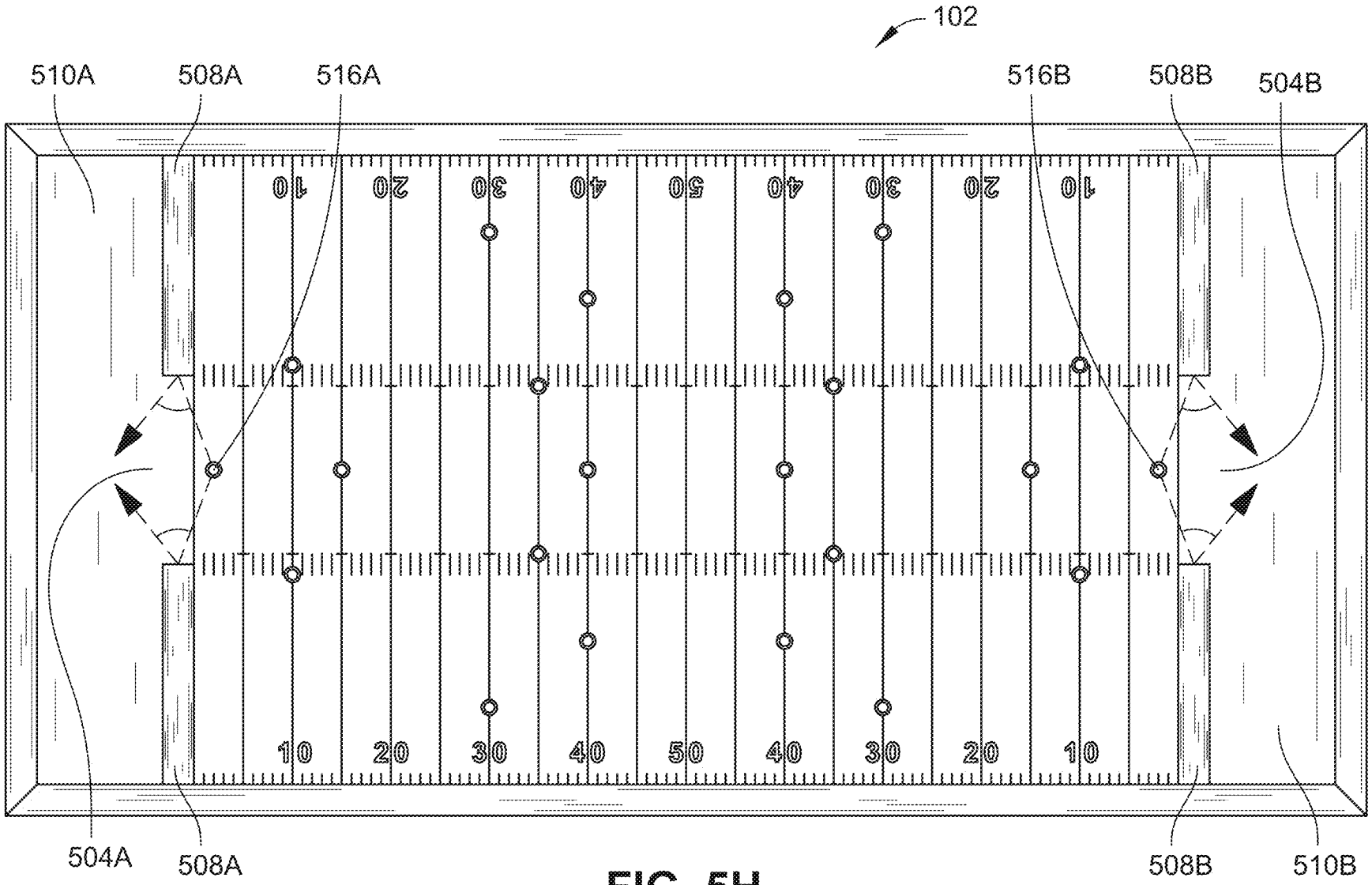
FIG. 5H is another top view of the sport simulation board game apparatus illustrated in FIG. 5A.

Referring now to FIG. 5H, the angles defined by the spacing of the pegs are also significant. For example, the pegs 516A, 516B disposed centrally in front of the openings 504A, 504A can be positioned in respect to goal members 508A, 508B so that a chip banked (e.g., deflected) off of the peg to strike one of the goal members 508A, 508B at an acute or 90 degree angle enters the respective end zone 510A, 510B.

The positioning of the pegs can also increase the amount of skill, challenge, and unpredictability in the game. For example, the placement of pegs 516A, 516B at locations that are equidistant from the sides of the game board 102 prevents players from scoring direct shots from the center of the game board. Players can develop a strategy by determining shot angles, determining bank shots, and so forth. Thus, the game includes an element of skill that a player can improve upon over time. In embodiments, the number of pegs on the game board can be increased or decreased to adjust the difficulty of game play. For example, a game board 102 designed for younger players may have fewer pegs.

It is to be noted that the foregoing configurations of pegs are offered by way of example only and are not meant to be restrictive of the present disclosure. In other embodiments other peg arrangements may be selected based on desired skill level, degree of difficulty, appearance, and so forth.

Example Soccer Game Board Embodiment

Referring now to FIGS. 6A through 6H, the recessed interior surface 108 can be configured as a soccer field. The interior surface can include goals 602A, 602B located near each end of the game board 102, respectively. In some embodiments, each goal 602A, 602B can comprise one or more centrally located openings defined by one or more goal members. The openings face each other as on a traditional soccer field. For example, the recessed interior can include a first opening 604A and a second opening 604B located on opposing ends of the elongated game board 102. In some embodiments, the first and second openings 604A, 604B are bound by respective goal lines 606A, 606B. In embodiments, each of the openings 604A, 604B can be formed by two members 608A, 608B extending from the ends of the game board to form a goal 602A, 602B. The width of the openings 604A, 604B is significant in terms of the relationship to the chip 104 diameter. For example, an opening width can be selected that is wide enough for the chip 104 to pass through, but narrow enough to create a challenge for players. The width of the openings 604A, 604B is also significant in relation to the positioning of the pegs, as discussed below. For example, an opening width can be selected that permits the game chip 104 to pass through on either side of a peg positioned in front of the opening 604A, 604B. In some example embodiments, the opening width can be between about 3.5 inches and about 5.5 inches. In some embodiments, the goals 602A, 602B can be covered by mesh, netting, or a similar material.

In embodiments, the interior surface 108 can include a plurality of lines and markings representative of a traditional soccer field. For example, the interior surface 108 can include a midfield line 612, which extends parallel to the goals and divides the interior surface approximately in half. Lines can also indicate the goal area 622A, 622B, the penalty line 624A, 624B, the penalty arc 626A, 626B, the center circle 628, the corner arc 630A, 630B, and/or the boundary lines 632A, 632B, 632C, 632D. The lines can be applied to the recessed interior surface 108 using any suitable technique including, but not necessarily limited to: screen printing, digital printing, hand painting, and so forth.

Figure 6A:
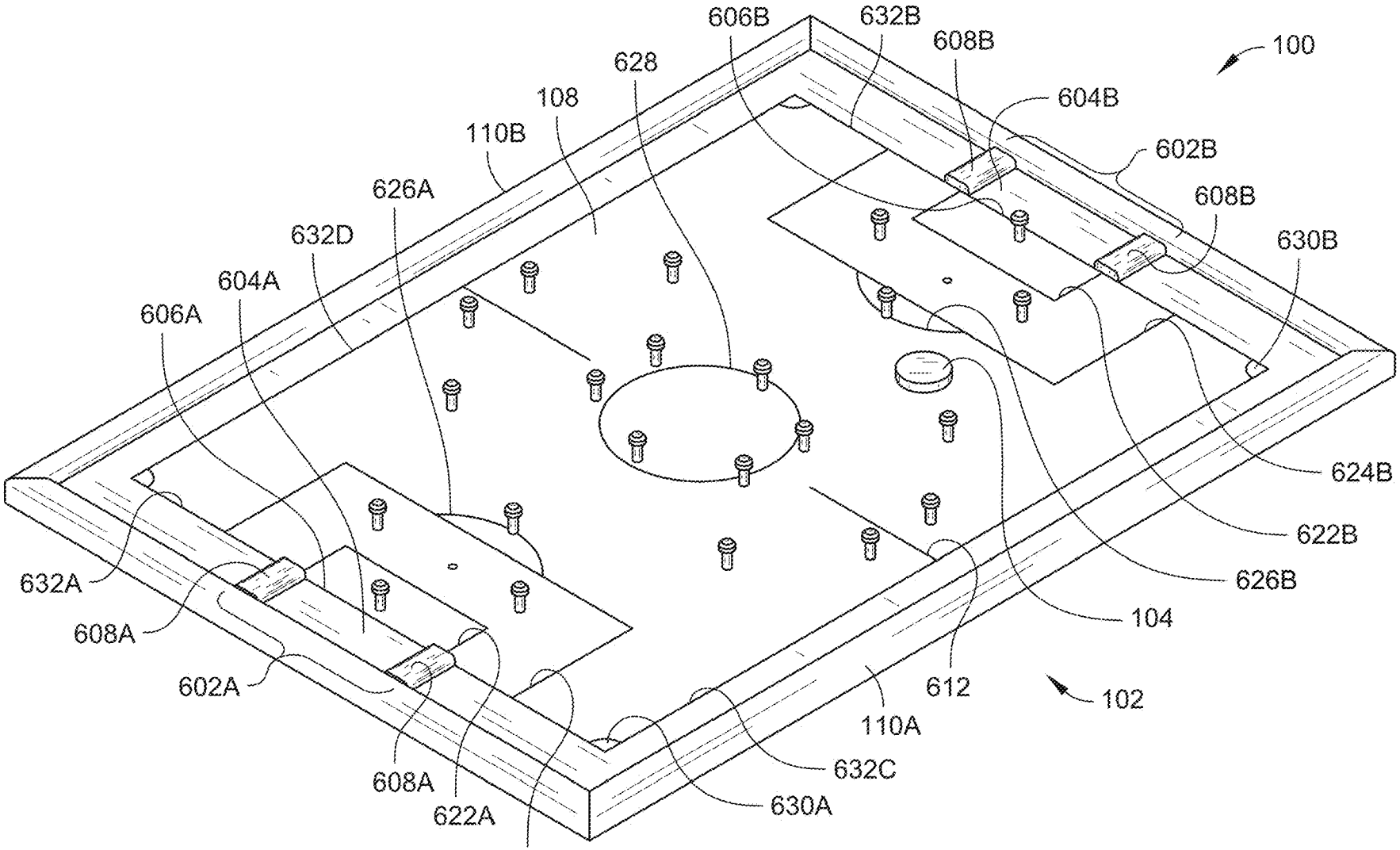
FIG. 6A is a perspective view illustrating a sport simulation board game apparatus configured as a soccer field in accordance with example embodiments of the present disclosure.

Still referring to FIGS. 6A through 6H, the game board 102 further comprises a plurality of pegs securely (e.g., immovably, permanently, etc.) attached to the recessed interior surface 108. In embodiments, pegs can be formed from wood, plastic, metal, or the like. The pegs can be positioned so as to simulate a soccer game and/or provide an obstacle for the chip 104. For example, there can be approximately 11 pegs disposed on each side of the midfield line 612. The pegs can also be positioned in such a way as to approximate the locations of players on a soccer field. In some embodiments, the pegs can be placed in a curvilinear arrangement by positioning the pegs in curvilinear lines extending away from the center of the game board 102, to approximate the positions of soccer players, as illustrated in FIG. 6A. The curvilinear lines can be defined by a conic section (e.g., parabola, hyperbola, ellipse, circle, etc.) with the peg placed at the vertex of each line located at a position that is equidistant from the sides of the game board 102.

Figure 6B:
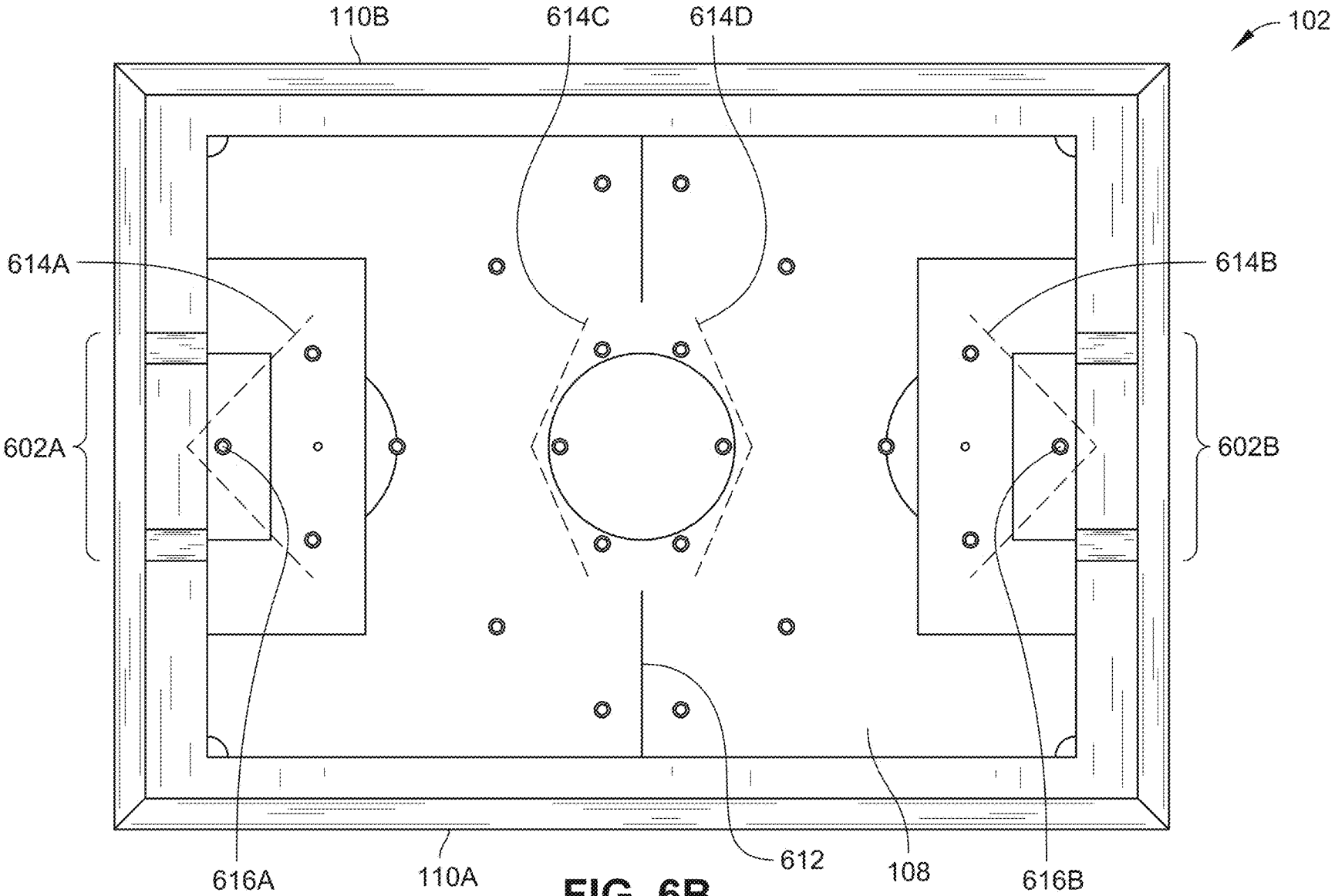
FIG. 6B is a top view of the sport simulation board game apparatus illustrated in FIG. 6A.
Figure 6C:
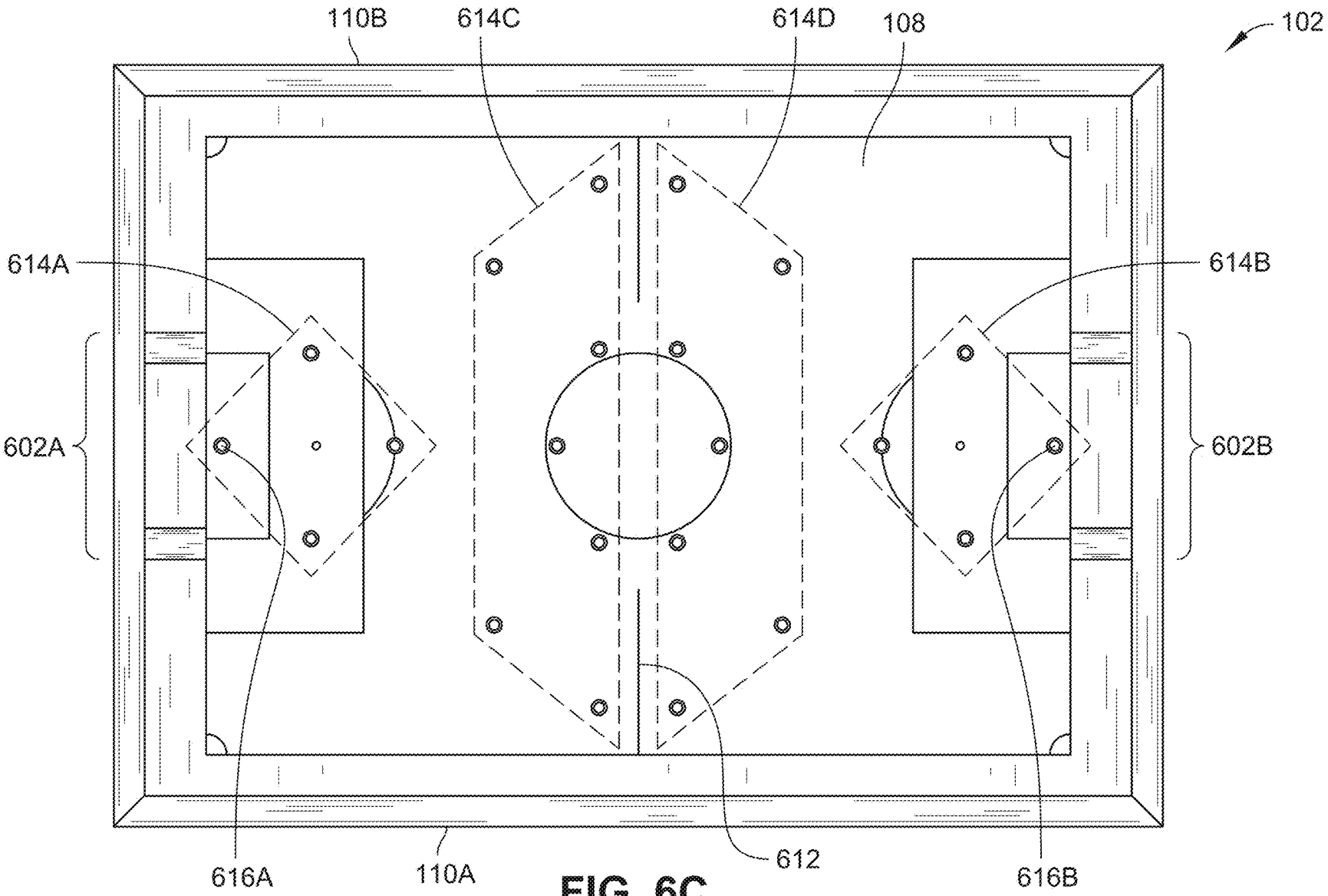
FIG. 6C is another top view of the sport simulation board game apparatus illustrated in FIG. 6A.

Referring now to FIGS. 6B and 6C, the game board 102 can include first and second sets of pegs 614A, 614B disposed proximate to the goals 602A and 602B, respectively. These sets of pegs 614A, 614B can be disposed in a chevron arrangement (e.g., as described with reference to FIG. 6B) or a quadrilateral (e.g., diamond, rhombus, etc.; as described with reference to FIG. 6C) arrangement, with at least one peg 616A, 616B centrally positioned in front of each goal 602A, 602B. These centrally positioned pegs 616A, 616B are disposed equidistant from the sides of the game board 102, and are configured to deflect direct shots of the chip taken from the center of the game board and prevent direct shots on goal.

In some embodiments, the game board 102 can also include one or more additional sets of pegs. For example, the game board 102 can include third and fourth sets of pegs 614C and 614D, respectively, disposed in a chevron configuration (e.g., as described with reference to FIG. 6B). For example, the recessed interior surface 108 can include a third set of pegs 614C arranged in a third chevron disposed proximate to and facing the midfield line 612. The interior surface can also include a fourth set of pegs 614D arranged in a fourth chevron disposed proximate to and facing the midfield line 612, and disposed on an opposing side of the midfield line 612 from the third set of pegs 614C.

As shown in FIGS. 6B and 6C, the plurality of pegs (e.g., sets of pegs 614A, 614B, 614C, 614D) can define one or more gaps of space dividing the plurality of pegs into discrete groups. The gap of space provides at least one unobstructed portion of the recessed interior surface 108 having no pegs and spanning the width of the game board (e.g., between sides 110A and 110B).

Referring now to FIG. 6C, one or more of the pegs can be arranged in a trapezoidal configuration. For example, the pegs can be arranged in sets to form one or more trapezoids. In an embodiment, the third set of pegs 614C can define a first trapezoid and the fourth set of pegs 614D can define a second trapezoid. For example, the third set of pegs 614C and the fourth set of pegs 614D can define first and second trapezoids, respectively, disposed proximate to and on opposing sides of the midfield line 612.

Figure 6D:
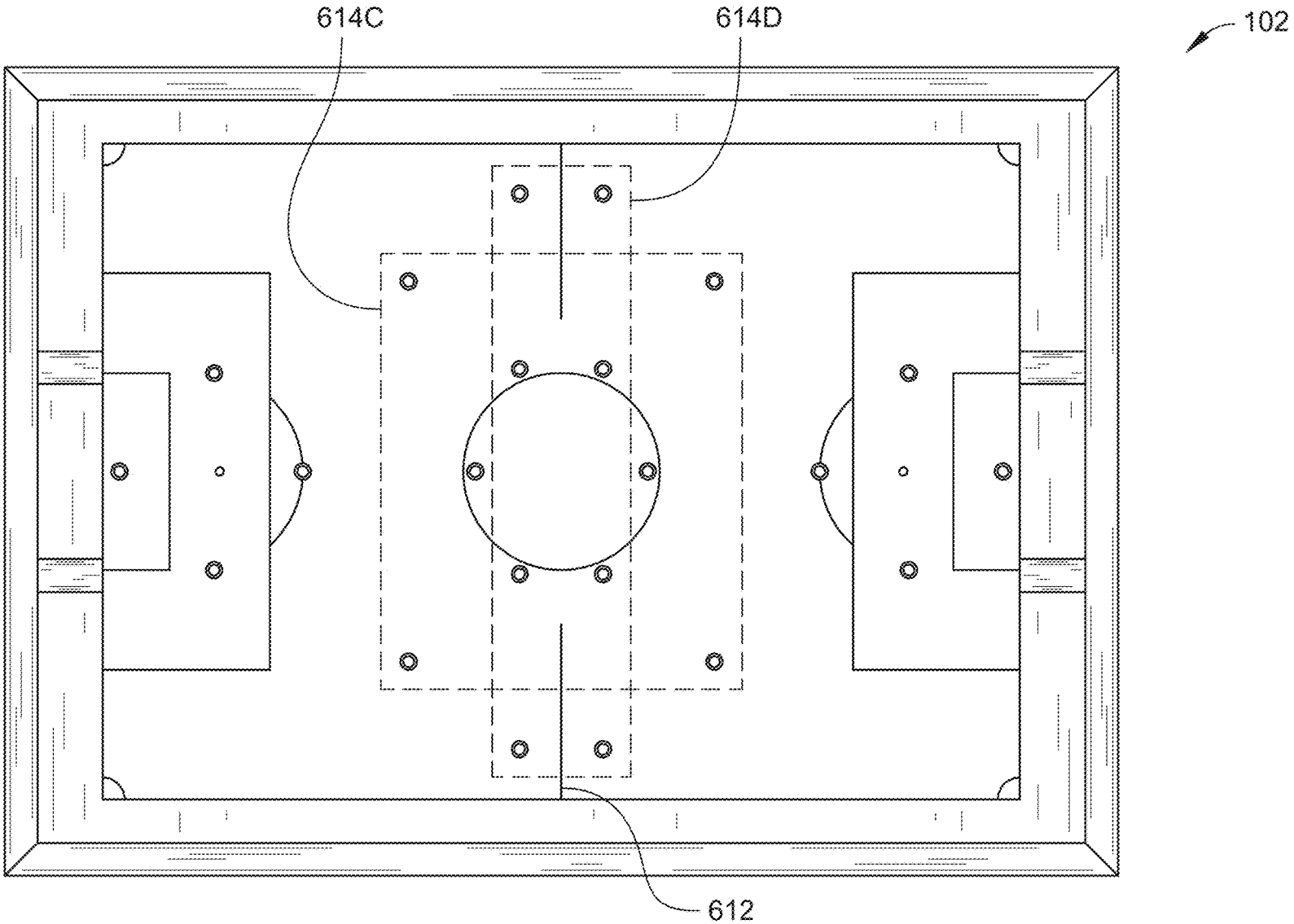
FIG. 6D is another top view of the sport simulation board game apparatus illustrated in FIG. 6A.

Referring now to FIG. 6D, one or more of the pegs can be arranged in a rectangular configuration. For example, the pegs can be arranged in sets to form one or more rectangles. In an embodiment, the third set of pegs 614C is arranged in a first rectangle, and the fourth set of pegs 614D arranged in a second rectangle which intersects the first rectangle. The third and fourth set of pegs 614C, 614D can overlap the midfield line 612.

Figure 6E:
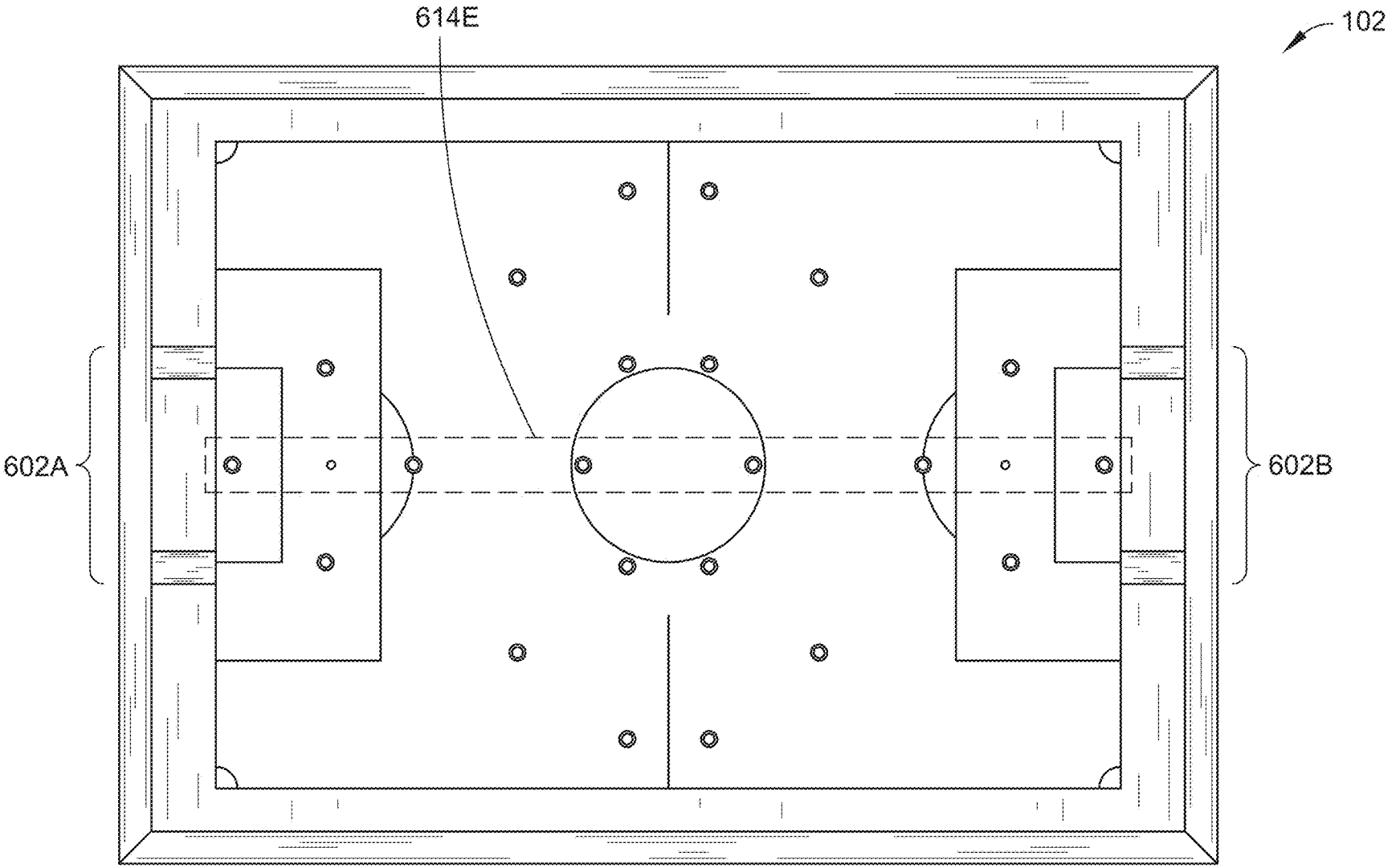
FIG. 6E is another top view of the sport simulation board game apparatus illustrated in FIG. 6A.

Referring now to FIG. 6E, a plurality of pegs may be arranged in a transverse line extending lengthwise across the recessed surface 108. For example, the game board 102 can include a set of pegs 614E extending transversely and lengthwise (e.g., parallel to the sides of the game board) across the center of the recessed surface 108 from goal 602A to goal 602B. This set of centrally positioned pegs 614E is configured to deflect direct shots of the chip taken from the center of the game board.

Figure 6F:
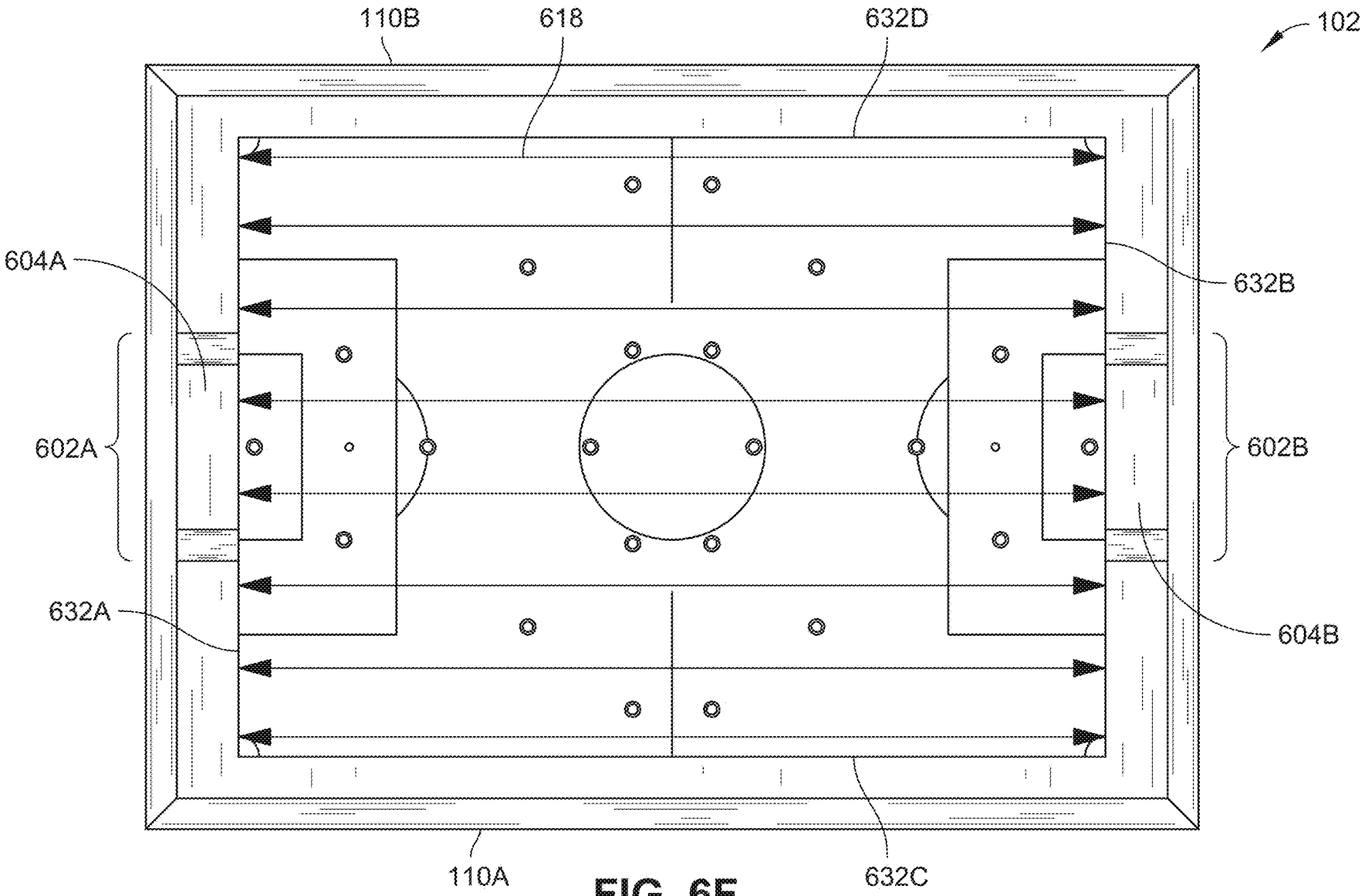
FIG. 6F is another top view of the sport simulation board game apparatus illustrated in FIG. 6A.
Figure 6G:
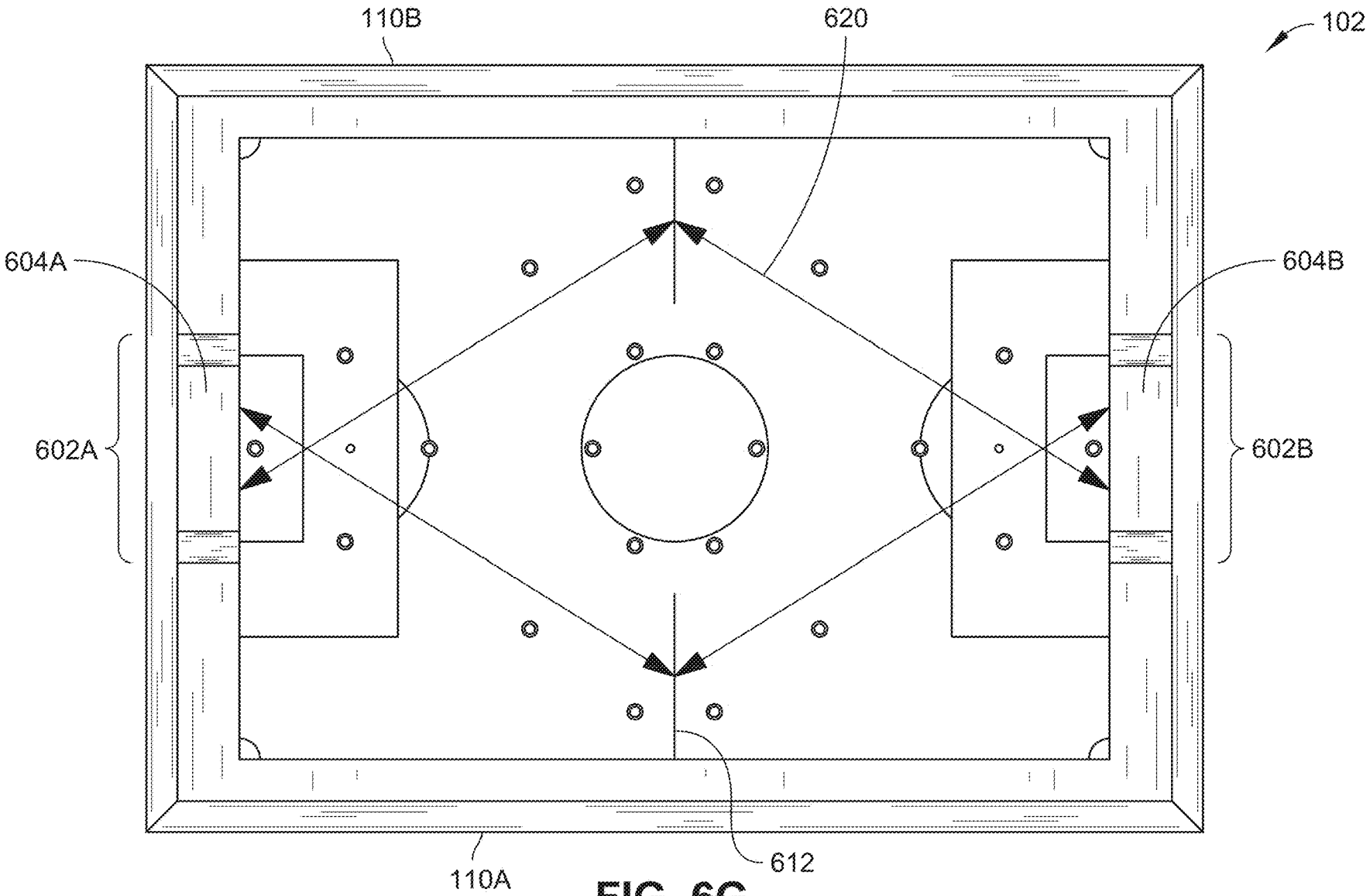
FIG. 6G is another top view of the sport simulation board game apparatus illustrated in FIG. 6A.

Referring now to FIGS. 6F and 6G, the pegs may define one or more channels for allowing the chip to pass. For example, the pegs can define one or more channels 618 extending transversely and lengthwise (e.g., parallel to the sides of the board 102) across the recessed interior surface 108 from boundary line 632A to opposing boundary line 632B (e.g., as described with reference to FIG. 6F). The pegs in combination with the perimeter of the game board 102 and/or the boundary lines 632A, 632B, 632C, 632D may also define transversely and lengthwise extending channels 618. The channels 618 can allow the chip to pass transversely across the length of the game board 102 without obstruction. For example, the chip can pass from goal 602A to opposing goal 602B without obstruction. The pegs may also define one or more diagonally extending channels 620 (e.g., as described with reference to FIG. 6G). The channels 620 allow the chip to pass diagonally across the game board 102 without obstruction. For example, the channels 620 allow the chip to pass from the midfield line 612 to either opening 604A, 604B without obstruction. The width of the channels 618, 620 is significant in terms of relationship to chip (not shown) size. For example, the width of the channels 618, 620 can be selected so as to be larger than the diameter of the chip, but narrow enough to provide a challenging obstacle. In some example embodiments, the channels 618, 620 can be at least about 1.25 inches to about 2.5 inches wide. The spacing of the pegs is also significant in terms of the relationship to the chip. The spacing is selected so as to be larger than the diameter of the chip and allow the chip to pass between the pegs, but small enough to provide a challenging obstacle. In some example embodiments, the pegs can be spaced at least about 1.25 inches to about 2.5 inches apart. Additionally, the spacing between the outermost pegs and the sides 110A, 110B of the game board 102 can be at least about 1.25 inches to about 2.5 inches. In embodiments, the spacing between pegs can be increased or decreased to adjust the difficulty of game play. For example, a game board 102 designed for younger players may have wider spacing between pegs. The transversely extending channels 618 and the diagonally extending channels 620 can increase the amount of skill and challenge required for game play. For example, players can use channels 618, 620 and strategic bank shots to score more efficiently.

Figure 6H:
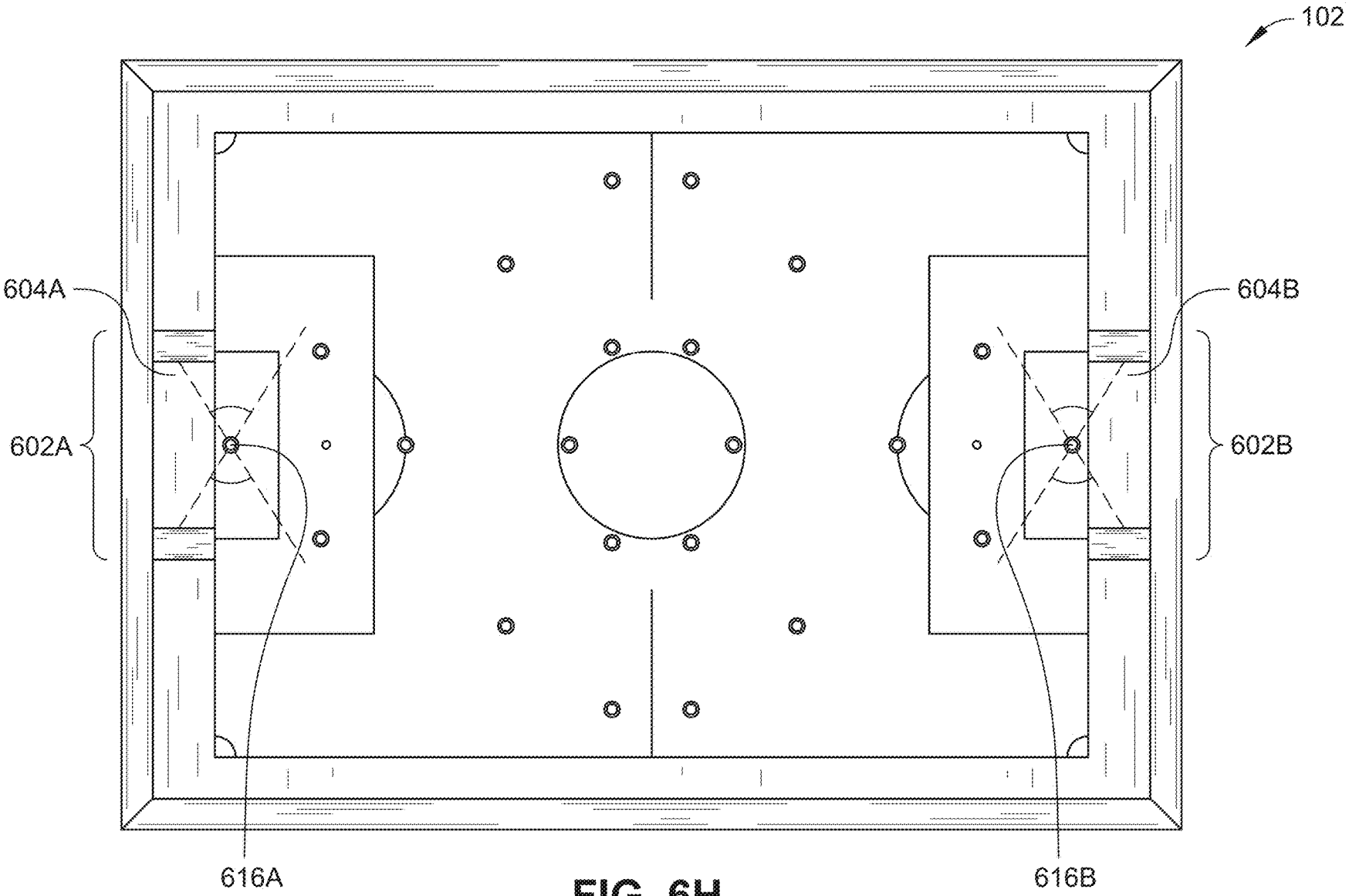
FIG. 6H is another top view of the sport simulation board game apparatus illustrated in FIG. 6A.

Referring now to FIG. 6H, the angles defined by the spacing of the pegs are also significant. For example, the pegs 616A, 616B disposed centrally in front of the openings 604A, 604B can be positioned so that a chip deflected off of the 616A, 616B at an acute or 90 degree angle enters the respective goal 602A, 602B.

The positioning of the pegs can also increase the amount of skill, challenge, and unpredictability in the game, as described above. For example, the placement of pegs 616A, 616B at locations that are equidistant from the sides 110A, 110B of the game board 102 prevents players from scoring direct shots from the center of the game board. Players can develop a strategy by determining shot angles, determining bank shots, and so forth. Thus, the game includes an element of skill that a player can improve upon over time. In embodiments, the number of pegs on the game board 102 can be increased or decreased to adjust the difficulty of game play. For example, a game board 102 designed for younger players may have fewer pegs.

It is to be noted that the foregoing configurations of pegs are offered by way of example only and are not meant to be restrictive of the present disclosure. In other embodiments other peg arrangements may be selected based on desired skill level, degree of difficulty, appearance, and so forth.

Example Basketball Game Board Embodiment

Figure 7A:
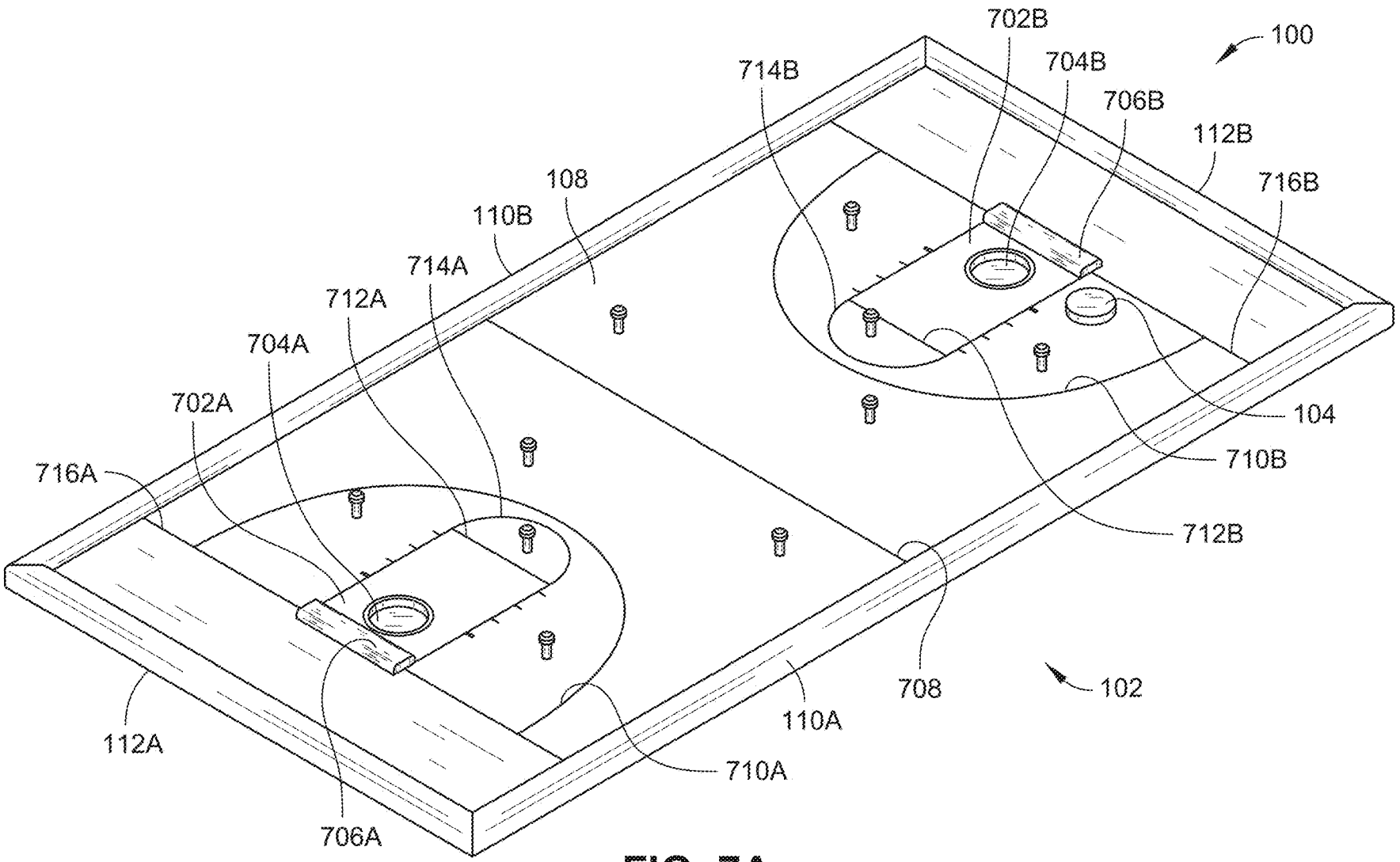
FIG. 7A is a perspective view illustrating a sport simulation board game apparatus configured as a basketball court in accordance with example embodiments of the present disclosure.
Figure 7B:
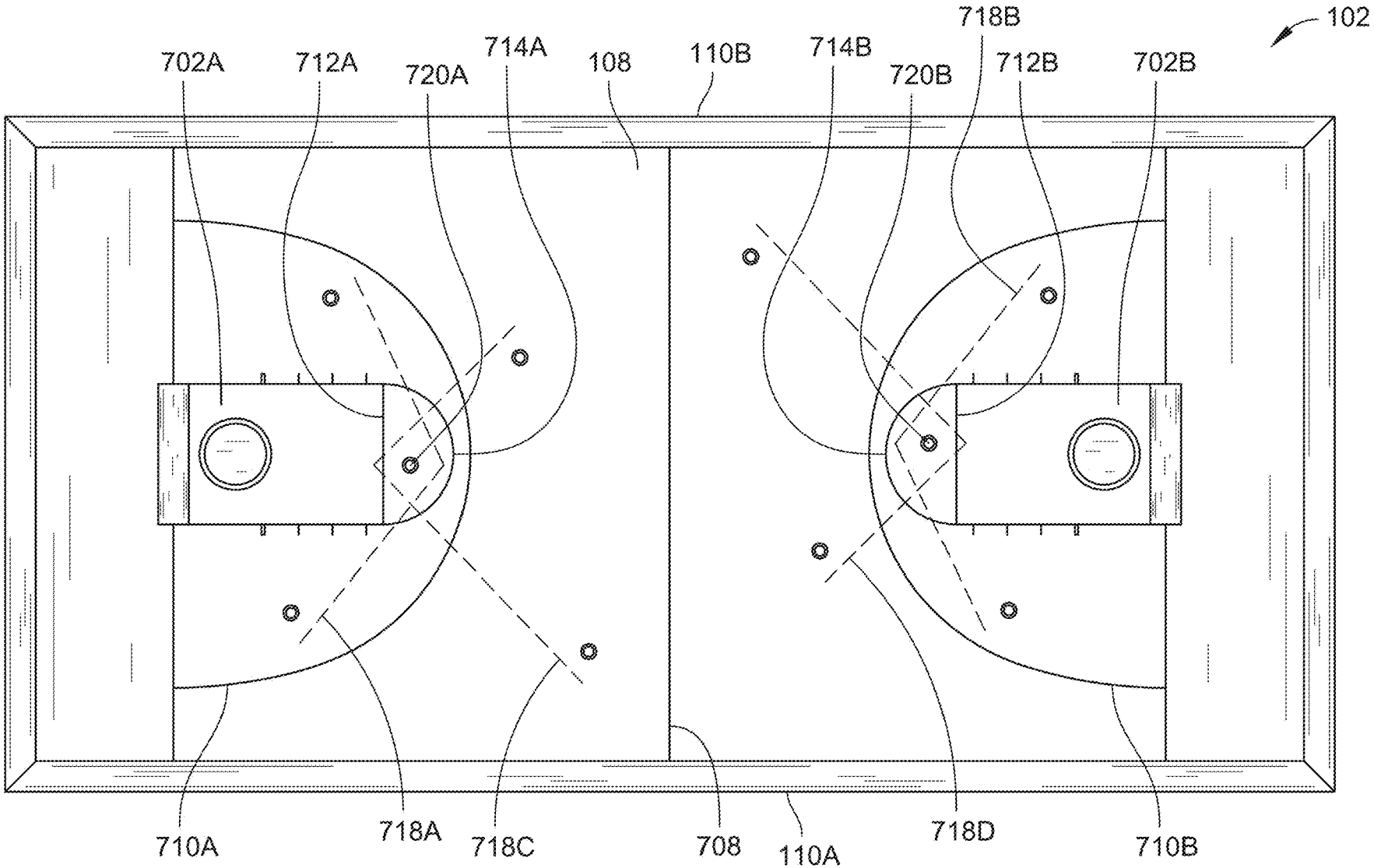
FIG. 7B is a top view of the sport simulation board game apparatus illustrated in FIG. 7A.
Figure 7C:
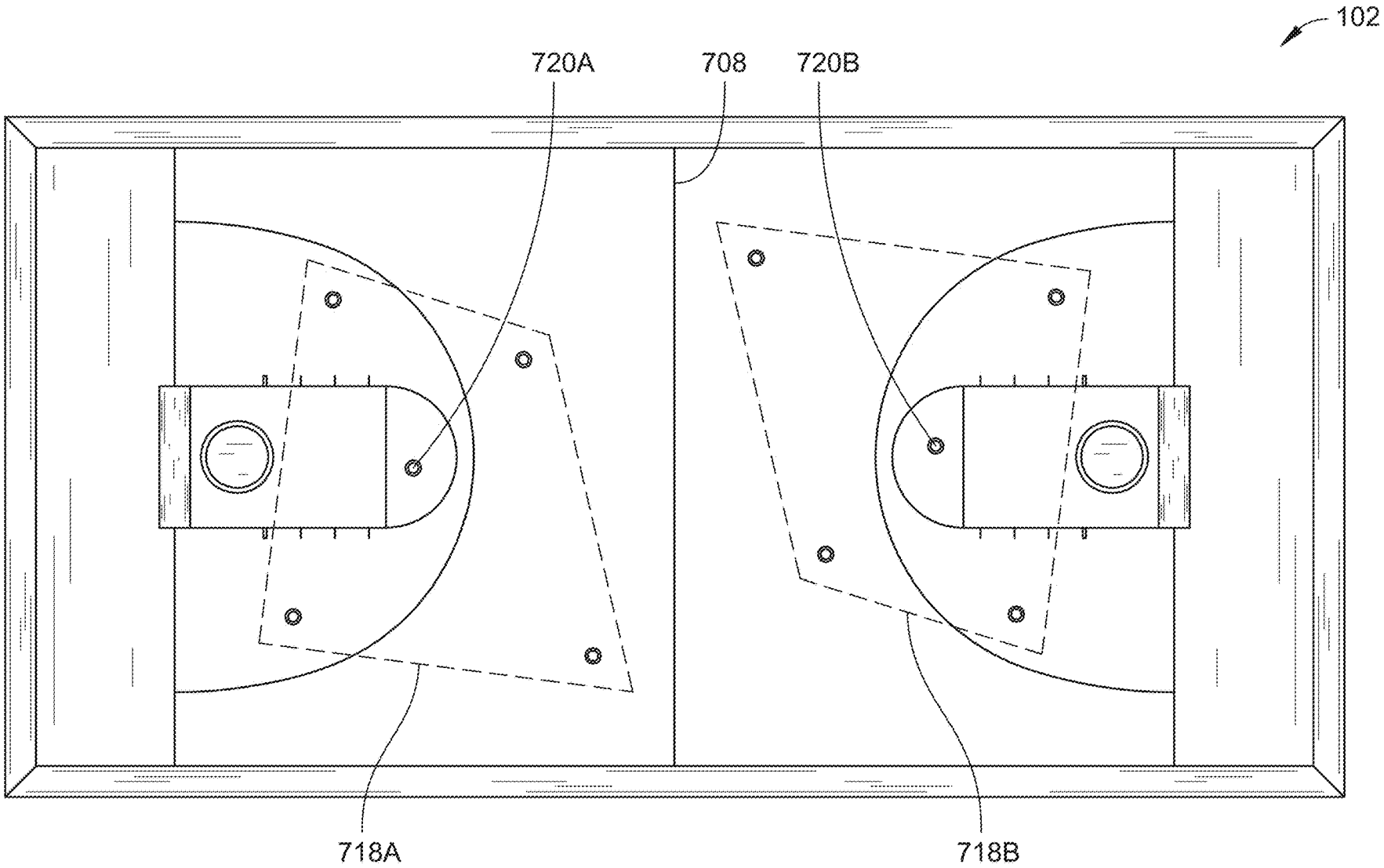
FIG. 7C is another top view of the sport simulation board game apparatus illustrated in FIG. 7A.

Referring now to FIGS. 7A through 7C, the recessed interior surface 108 can be configured as a basketball court. The interior surface can include goals (e.g., baskets) 702A, 702B located near each end of the game board 102, respectively. In some embodiments, the goals 702A, 702B can be configured as centrally positioned baskets. The baskets face each other as on a traditional basketball court. For example, the recessed interior 108 can include a first slot 704A and a second slot 704B located on opposing ends 112A, 112B of the elongated game board 102. Each of the first and second slots 704A, 704B are positioned proximate to a backboard member 706A, 706B. In embodiments, the slots 704A, 704B can comprise circular slots, as illustrated in FIGS. 7A through 7C. In embodiments, the depth of the 704A, 704B is significant in terms of retention of the chip 104. For example, a depth should be selected that permits the slot 704A, 704B to retain the chip 104 when the chip 104 enters the slot 704A, 704B. In specific embodiments, the slots 704A, 704B are approximately 0.2 inches to approximately 0.5 inches deep. In embodiments, the diameter of the slots 704A, 704B is significant in terms of the relationship to the chip 104 diameter. For example, a slot 704A, 704B width can be selected that is wide enough to retain the chip 104, but narrow enough to create a challenge for players. The diameter of the slots 704A, 704B is also significant in terms of relationship to the backboard members 706A, 706B. In specific embodiments, the ratio between the width of each slot 704A, 704B and each backboard member 706A, 706B is approximately 1:1.5 and the ratio between the each backboard member 706A, 706B and the side-to-side width of the recessed interior surface 108 is approximately 1:4. In specific embodiments, the backboard member 706A, 706B can be approximately 3.5 inches to approximately 4.5 inches long, and approximately 0.5 inches to approximately 1.5 inches wide. In some embodiments, the goals 702A, 702B can be covered by mesh, netting, or a similar material. The use of goals 702A, 702B comprising circular slots 704A, 704B of the specified dimensions is offered by way of example only and is not meant to be restrictive of the present disclosure. In other embodiments, the slots 704A, 704B can comprise any shape (e.g., oval, rectangular, and so forth) and any size large enough to retain the chip 104.

In embodiments, the interior surface 108 can include a plurality of lines and markings representative of a traditional basketball court. For example, the interior surface can include a center line 708, which extends parallel to the goals 702A, 702B and divides the interior surface 108 approximately in half. Lines can also indicate the three-point line 710A, 710B, free throw line 712A, 712B, the free throw lane 714A, 714B (e.g., the key), the center circle (not pictured), sidelines (not pictured), and/or the boundary lines (e.g., baselines 716A, 716B). The lines can be applied to the recessed interior surface 108 using any suitable technique including, but not necessarily limited to: screen printing, digital printing, hand painting, and so forth.

Still referring to FIGS. 7A through 7C, the game board 102 further comprises a plurality of pegs securely (e.g., immovably, permanently, etc.) attached to the recessed interior surface. In embodiments, pegs can be formed from wood, plastic, metal, or the like. The pegs can be positioned so as to simulate a basketball game and/or provide an obstacle for the chip 104. For example, there can be five pegs disposed on each side of a center line 708. The pegs can also be positioned in such a way as to approximate the locations of players on a basketball court.

Referring now to FIG. 7B, the game board can include first and second sets of pegs 718A and 718B, respectively, disposed proximate to the goals 702A, 702B. These sets of pegs 718A, 718B can be disposed in a chevron arrangement, with at least one peg 720A, 720B centrally positioned in front of each goal 702A, 702B. These centrally positioned pegs 720A, 720B are disposed equidistant from the sides 110A, 110B of the game board 102, and are configured to deflect direct shots of the chip (not shown) taken from the center of the game board 102 and prevent direct shots on goal. In some embodiments, the pegs 720A, 720B are bound by the free throw lines 712A, 712B and the top of the free throw lanes 714A, 714B. For example, peg 720A is positioned between the free throw line 712A, and the top of the free throw lane 714A, and peg 720B is positioned between the free throw line 712B, and the top of the free throw lane 714B. In some embodiments, the third and fourth sets of pegs 718A, 718B can be bound by the three-point lines, 710A and 710B, respectively. This arrangement of pegs in close proximity to the goals 702A, 702B provides an obstacle to shots and can increase the difficulty of the game.

In some embodiments, the game board 102 can also include one or more additional sets of pegs. For example, the recessed interior surface 108 can include a third set of pegs 718C arranged in a third chevron disposed on one side of the center line 708, and a fourth set of pegs 718D defining a fourth chevron disposed on the opposing side of the center line 708.

As shown in FIGS. 7B and 7C, the plurality of pegs (e.g., sets of pegs 718A, 718B, 718C, 718D) can define one or more gaps of space dividing the plurality of pegs into discrete groups. The gap of space provides at least one unobstructed portion of the recessed interior surface 108 having no pegs and spanning the width of the game board (e.g., between sides 110A and 110B).

In one or more embodiments, the first and third sets of pegs 718A, 718C intersect, and the second and fourth sets of pegs 718B, 718D can intersect. For example, the first set of pegs 718A can intersect with the third set of pegs 718C at peg 720A, and the second set of pegs 718B can intersect with the fourth set of pegs 718D at peg 720B.

Referring now to FIG. 7C, one or more of the pegs can be arranged in a quadrilateral configuration. For example, the first set of pegs 718A can define a first quadrilateral and the second set of pegs 718B can define a second quadrilateral. The first and second set of pegs 718A, 718B can be disposed on opposing sides of the center line 708. In this embodiment, peg 720A can be bound by the first set of pegs 718A, and peg 720B can be bound by the second set of pegs 718B.

In embodiments, the spacing of the pegs is also significant in terms of the relationship to the chip (not shown). The spacing is selected so as to be larger than the diameter of the chip and allow the chip to pass between the pegs, but small enough to provide a challenging obstacle. In some example embodiments, the pegs can be spaced at least approximately 1.25 inches to approximately 2.5 inches apart. Additionally, the spacing between the outermost pegs and the sides 110A, 110B of the game board 102 can be at least about 1.25 inches to about 2.5 inches. In embodiments, the spacing between pegs can be increased or decreased to adjust the difficulty of game play. For example, a game board 102 designed for younger players may have wider spacing between pegs.

The positioning of the pegs can also increase the amount of skill, challenge, and unpredictability in the game, as described above. For example, the placement of pegs 718A, 718B at locations that are equidistant from the sides 110A, 110B of the game board 102 prevents players from scoring direct shots from the center of the game board 102. Players can develop a strategy by determining shot angles, determining bank shots, and so forth. Thus, the game includes an element of skill that a player can improve upon over time. In embodiments, the number of pegs on the game board 102 can be increased or decreased to adjust the difficulty of game play. For example, a game board 102 designed for younger players may have fewer pegs.

It is to be noted that the foregoing configurations of pegs are offered by way of example only and are not meant to be restrictive of the present disclosure. In other embodiments other peg arrangements may be selected based on desired skill level, degree of difficulty, appearance, and so forth.

Figure 8:
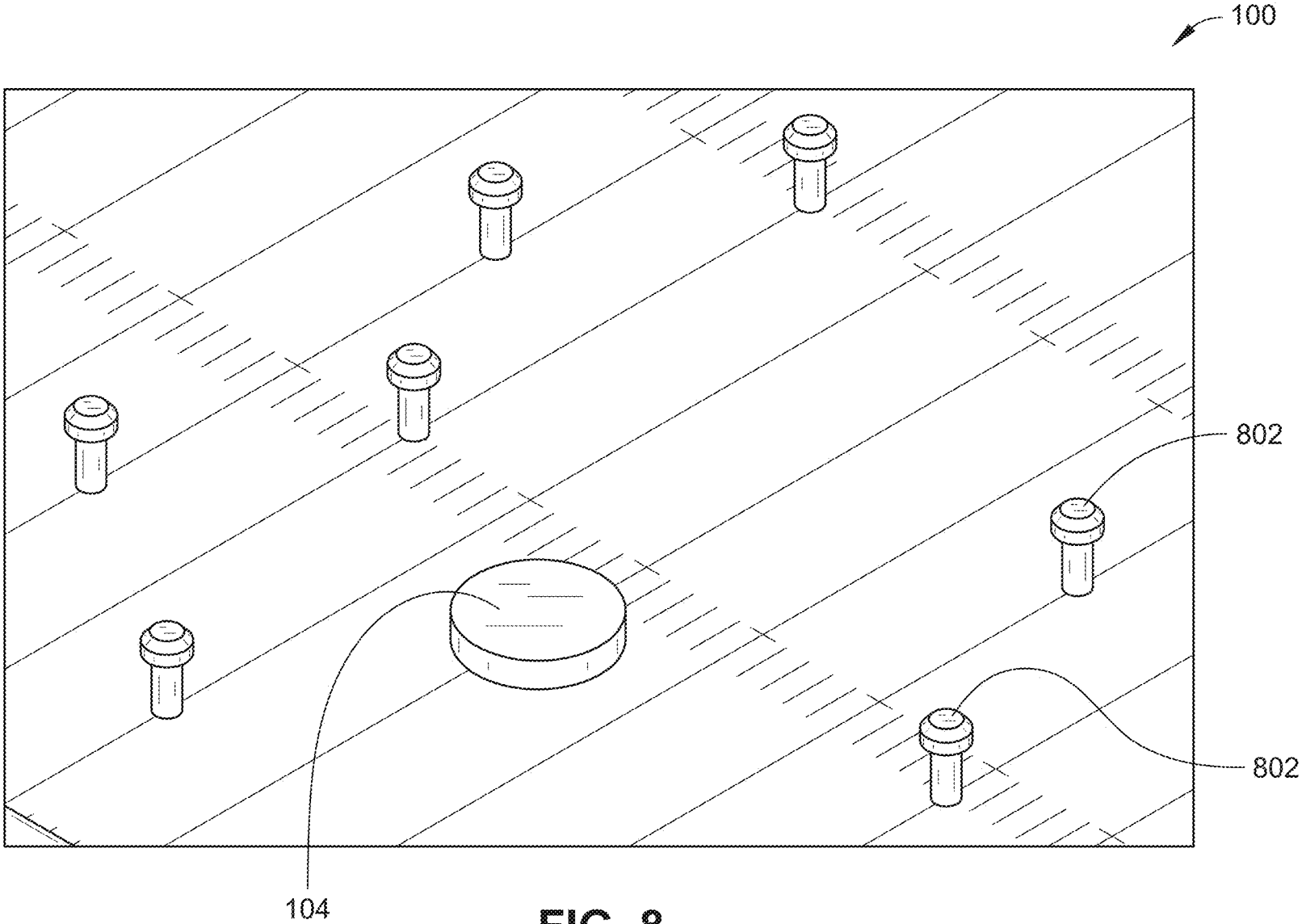
FIG. 8 is a perspective view illustrating the game chip and the pegs of a sport simulation board game apparatus, such as the sport simulation board game apparatus illustrated in FIG. 1, in accordance with example embodiments of the present disclosure.

Referring now to FIG. 8, the sport simulation board game apparatus 100 also includes one or more game chips 104, as described above. The chip 104 comprises a flat bottom surface that is configured to move (i.e., slide) across a game board when propelled (i.e., "flicked") by the hand of a user. The game chip can be representative of a ball or puck, depending on the sport being simulated (e.g., representative of a soccer ball for soccer, a hockey puck for hockey, etc.). The chip 104 comprises a solid, circular disk that can be constructed from one or more different materials including, but not necessarily limited to: wood, plastic, and so forth. However, a game chip 104 comprising a solid disk is provided by way of example and is not meant to limit the present disclosure. In other embodiments, the chip 104 can comprise a different shape (e.g., oblong, ring, etc.). In some embodiments, the chip 104 can be plain (e.g., unpainted wood, bare plastic, etc.). In other embodiments, the chip 104 can be colored and/or stylized with a design (e.g., stylized with the lacing of a football, checked pattern of a soccer ball, etc.).

The thickness and diameter of the game chip 104 is significant in relation to both the spacing of the pegs, and in relation to average user hand size. For example, a thickness and diameter can be selected that enable the chip to be flicked by at least one finger. A diameter can also be selected that allows the game chip to pass between and/or ricochet off the pegs 802, as illustrated in FIG. 8. A thickness can be selected that makes the height of the chip 104 shorter than the cap on the peg. In an example embodiment, the chip 104 can have a diameter of approximately 1.25 inches and can be approximately 0.3 inches thick.

It should be evident that many variations or design modifications of the sport simulation board game apparatus 100 are possible without departing from its basic concept. The game board may, for example, take on various sizes or shapes. The openings can similarly be designed in various sizes, shapes and placed in different positions around the board to make the game more or less difficult. The pegs can be designed in various sizes and/or shapes. The pegs can also be placed in different positions around the board to make the game more or less difficult, and/or to more realistically simulate the number of players on and/or the positions of an athletic team. The game chips can be designed in various sizes and/or shapes. Ball bearing rollers may be affixed to the bottom of the game chip to speed up play and create further excitement in the game. The ability to alter the sport simulation board game apparatus 100 to increase or decrease difficulty and/or realisticness enables game play to be enjoyed by users of a variety of ages and skill levels. It is contemplated that the board game apparatus 100 may also be configured for sports other than those illustrated herein (e.g., hockey).

Example Method of Play

Example Method of Play for Football and Soccer Embodiments

The game is played by two opposing teams, with each team comprising one or more individual users (i.e., players). If the team includes multiple players, the individual players can take turns (e.g., one kick per person, then play changes to the opposing team; one kick per team alternating which player kicks, with play changing to the opposing team after each kick, etc.).

A first player advances the game chip from the center of the field (i.e., center of the game board) towards the opposing team's goal. The first player advances the chip by propelling (i.e., flicking) the chip with one or more fingers. In implementations, a player may not score off of the initial flick. If the player scores off the initial flick, the goal is invalid and the player can start again by flicking the game chip from the center of the field.

A second player then advances the chip towards the first player's goal from the position where it landed after the first player's flick.

Players alternate turns until one player scores a goal by flicking the game chip across the opposing team's goal line. Scoring can differ depending on the sport simulation. For example, in a soccer simulation, a goal is scored when the entire game chip crosses the opposing team's goal line. Alternatively, in a football simulation, a goal (i.e., touchdown) is scored when the game chip breaks the barrier of the goal line. To score a goal, the game chip should remain flat against the game board (e.g., cannot jump or flip over pegs or other barriers). In implementations, if the game chip crosses the goal line and ricochets back into the field of play, the goal is still valid. Once a player scores, the game chip is returned to the center of the field and the non-scoring player flicks the game chip to reinitiate play.

Game play continues until a pre-determined number of points (e.g., goals, touchdowns, etc.) are achieved by a team. In an example implementation, the winner is the first team to score five points. In some implementations, players may receive extra points in specified scenarios. For example, a player that makes a goal/touchdown in three or fewer flicks may receive one or more bonus points. Players may also receive bonus points for scoring within a preselected time limit. In implementations, players can track their scores using a score card.

PENALTIES: Method of play can further include penalties to increase difficulty of play and enhance the realistic quality of the simulation. For example, a player may receive a penalty if the player's flick causes the game chip to come to rest partially or completely off the game board. In a football simulation, if the game chip comes to rest partially or completely off the board, the other player places the game chip near the area it left the board and takes two consecutive shots. In a soccer simulation, if the game chip comes to rest partially or completely off the board, the other player may either place the game chip near the area it left the board and take two consecutive shots, or place the chip in the center of the other player's four back pegs and take a penalty shot. However, this method of penalty play is provided by way of example and is not meant to limit the present disclosure. In other implementations, penalties may be given for other actions (e.g., skipping the game chip over the pegs, etc.) and/or have different consequences.

Example Method of Play for Basketball Embodiments

The game is played by two opposing teams, with each team comprising one or more individual users (i.e., players). If the team includes multiple players, the individual players can take turns (e.g., one pass per person, then play changes to the opposing team; one pass per team alternating which player passes, with play changing to the opposing team after each pass, etc.).

A first player advances the game chip from their baseline (e.g., anywhere behind their own baseline) towards the opposing team's goal (e.g., basket). The first player advances the chip by propelling (i.e., flicking) the chip with one or more fingers. In implementations, a player may not score off of the initial flick. In these implementations, the basket is invalid if the player scores off the initial flick, and the player can start again by flicking the game chip from behind their baseline.

The first player takes one or more additional flicks to advance the chip towards the second player's basket advancing the chip from the position it landed after the previous flick. In a specific embodiment, each player takes one flick after the initial flick to advance the chip towards the opposing basket.

In some implementations, a player may receive one or more bonus flicks based on the opposing player's inability to score a basket. In a specific implementation, a player receives a bonus flick (e.g., three consecutive flicks) if the opposing player misses a two-point basket attempt, as described herein, on the last flick of their possession.

A second player then advances the chip towards the first player's basket from the position where it landed after the last flick of the first player's possession.

Figure 9:
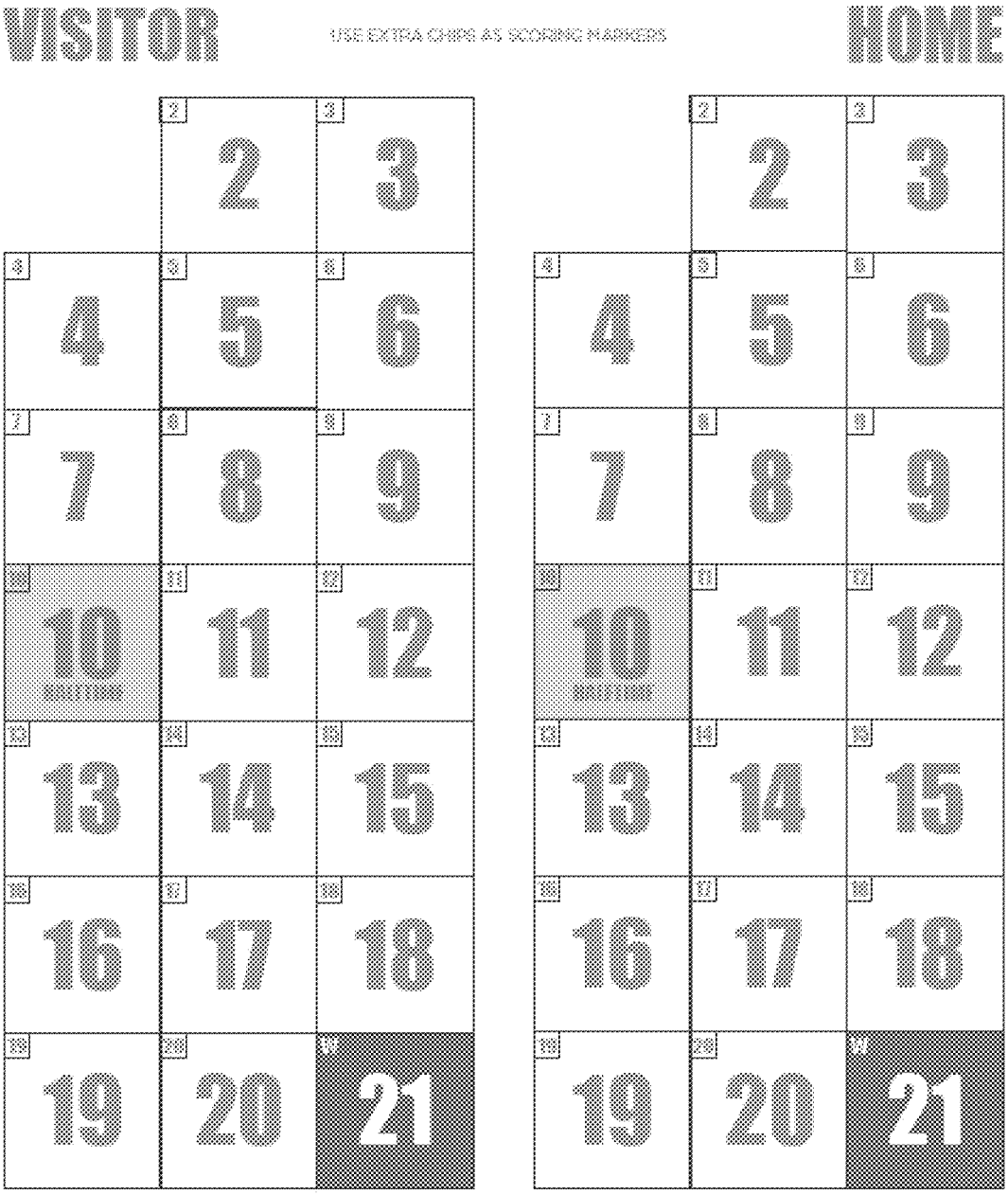
FIG. 9 is a top side view illustrating a score card for use with methods of playing a sport simulation game using a sport simulation board game apparatus in accordance with example embodiments of the present disclosure.

Players alternate turns until one player scores by flicking the game chip into the second player's basket. Points are scored by landing the chip in the opposing player's basket. In implementations, the player scores two or three points for a basket, depending on the position on the game board the chip was flicked from (e.g., as in traditional basketball. In some implementations, the game chip should remain flat against the game board (e.g., cannot jump or flip over pegs or other barriers) to score a basket. In some implementations, players may receive extra points in specified scenarios. For example, a player that makes a basket in preselected number of flicks may receive one or more bonus points. Players may also receive bonus points for scoring within a preselected time limit. In implementations, players can track their scores using a score care (e.g., as described with reference to FIG. 9).

After a player scores, the non-scoring player flicks the game chip from behind their baseline to reinitiate play.

Game play continues until a preselected number of points (e.g., baskets) are achieved by a team. In an example implementation, the winner is the first team to score twenty one points. In some implementations, possession of the chip can alternate at a point when one of the players is halfway to the preselected number of points (e.g., halftime). For example, in a twenty-one point game, halftime occurs when a player reaches ten points. At halftime, the player who did not start the game receives the ball behind their baseline.

PENALTIES: Method of play can further include penalties to increase difficulty of play and enhance the realistic quality of the simulation. For example, a player may receive a penalty if the player's flick causes the game chip to come to rest partially or completely off the game board, on top of the backboard, or beyond either team's baseline. If the game chip comes to rest partially or completely off the board, or on top of the backboard, the other player places the game chip near the area it left the board and takes three consecutive shots. If the chip goes beyond either team's baseline, the chip is placed behind the nearest baseline and the other player receives three consecutive flicks. However, this method of penalty play is provided by way of example and is not meant to limit the present disclosure. In other implementations, penalties may be given for other actions (e.g., skipping the game chip over the pegs, etc.) and/or have different consequences.

It is to be understood that the methods of game play described above may be implemented using the board game apparatus 100 described in FIGS. 1 though 8 above. It is also to be understood that the method of game play can be adjusted to accommodate players of different ages and skill levels, and to accommodate different numbers of players. For example, penalties can be added or eliminated, the consequences for penalties can be changed, the number of points required to win can be increased or decreased, and so forth. In some implementations, multiple game chips can be utilized in game play. The method of play can also be adjusted to more accurately reflect the real rules of the sport being simulated (i.e., soccer and basketball may have penalty shots, while football may not). In some implementations, the game may be played by a single player. For example, a single player can flick the game chip from one end of the game board towards the opposite goal.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sport simulation board game apparatus, comprising: an elongated game board, the elongated game board including:

a recessed interior surface including a first portion and a second portion separated by a center line, the recessed interior surface being set into a shoulder portion formed from first raised edge portions, the first raised edge portions forming a rim for retaining at least one game chip and defining an outer perimeter of the game board;

a first goal and a second goal disposed at opposing ends of the recessed interior surface, the first goal and the second goal formed from raised goal members extending upwardly from the recessed interior surface and extending inwardly from opposing side portions of the outer perimeter of the game board, the raised goal members defining first and second openings, respectively, and defining a field of play between the first and second openings, the first and second openings configured to allow the at least one game chip to pass through; and a plurality of pegs securely attached to the recessed interior surface, the plurality of pegs defining:

a first set of pegs disposed on the first portion of the recessed interior surface, the first set of pegs arranged in a first chevron and disposed proximate to the first opening, the first set of pegs positioned to at least partially obstruct the first opening;

a second set of pegs disposed on the second portion of the recessed interior surface, the second set of pegs arranged in a second chevron and disposed proximate to the second opening, the second set of pegs positioned to at least partially obstruct the second opening, the first set of pegs and the second set of pegs defining at least two channels for unobstructed movement of the at least one game chip across the elongated game board, the at least two channels positioned to allow the at least one game chip to move directly from the first goal to the second goal, the at least two channels being formed in the field of play to either side of a central portion of the first and second openings, wherein at least a predetermined number of the plurality of pegs are aligned in a substantially linear fashion with one another between the opposing ends and are aligned with a corresponding end portion of each of the raised goal members located distal from the outer perimeter at the opposing ends that forms a part of the first and second openings;

at least one gap of space positioned between the first set of pegs and the second set of pegs, the at least one gap of space dividing the first set of pegs and the second set of pegs into discrete groups, the at least one gap of space providing at least one unobstructed portion of the recessed interior surface spanning the width of the elongated game board; and at least one game chip, the at least one game chip configured to move across the elongated game board when a force is applied to said game chip by a player.

2. The sport simulation board game apparatus as recited in claim 1, wherein the plurality of pegs further includes a third set of pegs and a fourth set of pegs.

3. The sport simulation board game apparatus as recited in claim 2, wherein the third set of pegs is arranged in a third chevron and the fourth set of pegs is arranged in a fourth chevron.

4. The sport simulation board game apparatus as recited in claim 2, wherein at least one of the third set of pegs or the fourth set of pegs is arranged in a trapezoid.

5. The sport simulation board game apparatus as recited in claim 1, wherein the plurality of pegs defines at least one transversely extending channel.

6. The sport simulation board game apparatus as recited in claim 1, wherein the plurality of pegs defines at least one diagonally extending channel.

7. The sport simulation board game apparatus as recited in claim 1, wherein the plurality of pegs further includes:

a first peg disposed equidistant between a first side and a second side of the game board, the first peg positioned proximate to the first goal; and a second peg disposed equidistant between the first side and the second side of the game board, the second peg positioned proximate to the second goal.

8. The sport simulation board game apparatus as recited in claim 1, wherein the recessed interior surface is configured to be customizable with at least one of an image or text selected by an end user.

9. The sport simulation board game apparatus as recited in claim 1, wherein the elongated board is configured to simulate a soccer field or a football field.

10. The sport simulation board game apparatus as recited in claim 1, wherein one peg of the first set of pegs is disposed at a goal line of the first goal, the one peg of the first set of pegs being positioned equidistant between a first goal member and a second goal member to deflect the at least one game chip and propel the at least one game chip against at least one of the first goal member or the second goal member.

11. The sport simulation board game apparatus as recited in claim 10, wherein each of the first goal member and the second goal member is positioned to deflect the at least one game chip into the first goal when the at least one game chip strikes at least one of the first goal member or the second goal member at a ninety degree angle or at an acute angle.

* * * * *